US010642189B2

(12) United States Patent
Yamaguchi et al.

(10) Patent No.: US 10,642,189 B2
(45) Date of Patent: May 5, 2020

(54) DEVELOPER CONTAINER UNIT, DEVELOPING APPARATUS, AND PROCESS CARTRIDGE

(71) Applicant: CANON KABUSHIKI KAISHA, Tokyo (JP)

(72) Inventors: Koji Yamaguchi, Numazu (JP); Fumito Nonaka, Mishima (JP); Hiroki Ogino, Mishima (JP); Hiroomi Matsuzaki, Mishima (JP); Shunsuke Uratani, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/518,410

(22) Filed: Jul. 22, 2019

(65) Prior Publication Data

US 2020/0041930 A1 Feb. 6, 2020

(30) Foreign Application Priority Data

Jul. 31, 2018 (JP) ..... 2018-143288
Jul. 31, 2018 (JP) ..... 2018-143289
Jul. 31, 2018 (JP) ..... 2018-143290

(51) Int. Cl.
*G03G 15/08* (2006.01)

(52) U.S. Cl.
CPC ..... *G03G 15/0881* (2013.01); *G03G 15/0867* (2013.01)

(58) Field of Classification Search
CPC ..... G03G 15/0822; G03G 15/0867; G03G 15/0881; G03G 15/0887; G03G 15/0889; G03G 2215/0836; G03G 2215/0852
See application file for complete search history.

(56) References Cited

U.S. PATENT DOCUMENTS 3,013,703 A * 12/1961 Hunt ..... G03G 15/08 222/409
4,091,765 A * 5/1978 Lowthorp ..... G03G 15/0914 118/261

(Continued)

FOREIGN PATENT DOCUMENTS

JP 2002072681 A 3/2002
JP 2003084557 A 3/2003

(Continued)

*Primary Examiner* — David J Bolduc
(74) *Attorney, Agent, or Firm* — Canon U.S.A., Inc. IP Division

(57) ABSTRACT

A developer container unit to be mounted in an image forming apparatus that performs an image forming operation comprises a frame and a sealing unit. The frame is provided with a developer containing chamber containing developer and an opening for discharging the developer from the developer containing chamber. The sealing unit includes a shaft member rotatable about a rotational axis and a sealing portion attached to the shaft member and compressed by the shaft member and the frame to seal the opening. The sealing unit is rotatable to a close position at which the sealing portion seals the opening, a first open position at which the opening is open, and a second open position at which the opening is open. The sealing unit agitates the developer by executing a reciprocating motion between the first and second open positions during the image forming operation.

22 Claims, 19 Drawing Sheets

(56) References Cited

U.S. PATENT DOCUMENTS 4,435,065 A * 3/1984 Wada ..... G03G 15/0886 399/260
4,587,929 A * 5/1986 Connolly ..... G03G 15/09 118/261
5,239,346 A * 8/1993 Corbin ..... G03G 15/0877 118/612
5,649,264 A * 7/1997 Domon ..... G03G 15/0896 399/27
5,655,175 A * 8/1997 Oshida ..... G03G 15/0822 250/577
5,682,574 A * 10/1997 Oshida ..... G03G 15/0896 118/691
2003/0031479 A1* 2/2003 Ito ..... G03G 15/0822 399/27
2006/0062604 A1* 3/2006 Yamada ..... G03G 15/0868 399/262
2008/0080899 A1* 4/2008 Mase ..... G03G 15/0856 399/254
2008/0124119 A1* 5/2008 Oda ..... G03G 15/0898 399/120
2012/0093541 A1* 4/2012 Koyama ..... G03G 15/0889 399/254
2013/0164039 A1* 6/2013 Matsushita ..... G03G 21/18 399/258
2013/0164040 A1* 6/2013 Matsushita ..... G03G 15/0874 399/258
2013/0343785 A1* 12/2013 Matsuzaki ..... G03G 15/0874 399/258
2014/0079432 A1* 3/2014 Matsuzaki ..... G03G 15/0874 399/106
2014/0093272 A1* 4/2014 Matsumaru ..... G03G 15/0881 399/106
2014/0212166 A1* 7/2014 Takeuchi ..... G03G 15/0898 399/106
2015/0277287 A1* 10/2015 Nakajima ..... G03G 15/0887 399/260
2016/0048094 A1* 2/2016 Kusukawa ..... G03G 15/0891 399/274
2017/0285525 A1* 10/2017 Itabashi ..... G03G 15/0881
2018/0011426 A1* 1/2018 Mizutani ..... G03G 15/0898

FOREIGN PATENT DOCUMENTS

JP 2006276810 A 10/2006
JP 2015087663 A 5/2015
JP 2015105970 A 6/2015

* cited by examiner

DEVELOPER CONTAINER UNIT, DEVELOPING APPARATUS, AND PROCESS CARTRIDGE

BACKGROUND OF THE DISCLOSURE

Field of the Disclosure

The present disclosure relates to a developer container unit, a developing apparatus, and a process cartridge used in an image forming apparatus.

Description of the Related Art

As used herein, the term "image forming apparatus" refers to an apparatus for, for example, forming an image on a recording material by using an electrophotographic image forming process. Examples of an electrophotographic image forming apparatus include an electrophotographic copying machine, an electrophotographic printer (for example, an LED printer or a laser beam printer), and an electrophotographic facsimile machine.

The developer container unit contains a developer used for an image forming operation. The developing apparatus includes a developer bearing member that bears a developer. An image bearing unit includes an image bearing member that bears a latent image.

As used herein, the term "cartridge" refers to, for example, a developer container unit, a developing apparatus, or an image bearing unit that is removable from an image forming apparatus main body. The term "process cartridge" refers to a cartridge that includes the developer bearing member and the image bearing member and that is removable from the image forming apparatus main body.

By using the above-described cartridges, maintenance of the image forming apparatus can be facilitated.

The developer container unit includes a frame. The frame includes a developer container portion for containing developer therein and an opening for discharging the developer therethrough from the developer container portion. In addition, to prevent the developer from being discharged through the opening before the developer container unit is used, a developer container unit including a sealing member for sealing the opening has been proposed.

Japanese Patent Laid-Open No. 2015-105970 describes a configuration in which a sealing member welded to a wall around an opening is attached to a rotary member. The rotary member is driven to rotate by the apparatus body and, thus, the sealing member is peeled off from the periphery of the opening. The rotary member further functions as a developer (toner) feeding member.

Japanese Patent Laid-Open No. 2015-105970 describes a toner cartridge including a cover cartridge, an inner cartridge, and a sponge shutter. The outer peripheral surface of the sponge shutter is pressed against the inner peripheral surface of the cover cartridge and is in contact with the inner peripheral surface. In this manner, the opening is closed.

In the configuration described in Japanese Patent Laid-Open No. 2015-105970, the rotary member for peeling off the sealing member further functions as a toner feeding member. At this time, the sealing member needs to be welded around the opening. In the configuration described in Japanese Patent Laid-Open No. 2015-105970, a sponge shutter that is compressed to seal the opening is employed. Accordingly, the sponge shutter need not be welded around the opening. However, it is difficult to cause a part that moves the sponge shutter to function as a toner feeding member or an agitating member.

In addition, in a configuration employing a sealing member that is compressed to seal the opening as described in Japanese Patent Laid-Open No. 2015-105970, when the opening is open, the sealing member is moved while being compressed. For this reason, the load for moving the scaling member increases. In addition, a configuration has been developed in which an agitating member having an elastic sheet with an inclined notch is rotated to feed a developer in the direction of the rotational axis of the agitating member (refer to Japanese Patent Laid-Open No. 2006-276810).

SUMMARY OF THE DISCLOSURE

The present disclosure provides a structure capable of agitating toner by using a sealing member (a sealing unit) that need not be welded around an opening, and by moving a member for moving the sealing member during an image forming operation. The present disclosure further provides a decrease in the load for moving a sealing member in a structure using a sealing member compressed to seal the opening.

Various features and aspects of the disclosure related to the present application for solving the above-mentioned problems are herein now discussed below.

A developer container unit to be mounted in an image forming apparatus that performs an image forming operation on a recording material is provided. The developer container unit comprises a frame and a sealing unit. The frame is provided with a developer containing chamber configured to contain developer and an opening for discharging the developer from the developer containing chamber. The sealing unit is configured to seal the opening. The sealing unit includes a shaft member rotatable about a rotational axis and a sealing portion attached to the shaft member and compressed by the shaft member and the frame to seal the opening. The sealing unit is rotatable to a close position at which the sealing portion seals the opening, a first open position at which the opening is open, and a second open position at which the opening is open. The sealing unit is further configured to agitate the developer by executing a reciprocating motion between the first open position and the second open position during the image forming operation.

A developer container unit comprises a frame and a sealing unit. The frame includes a developer containing chamber configured to contain a developer and an opening configured to discharge the developer. The sealing unit is configured to seal the opening. The sealing unit includes a shaft member rotatable about a rotational axis and a sealing portion attached to the shaft member and compressed by the shaft member and the frame to seal the opening. The sealing unit is rotatable in an unsealing direction from a close position at which the sealing portion seals the opening toward an open position at which the opening is open. The frame includes a contact wall in contact with the sealing portion when the sealing unit moves from the close position to the open position. The contact wall and the shaft member are disposed such that, when the sealing unit rotates in the unsealing direction, the amount of compression of the sealing portion in an orthogonal direction that is orthogonal to the rotational axis decreases toward a downstream end in the unsealing direction.

Further features and aspects of the present disclosure will become apparent from the following description of example embodiments with reference to the attached drawings.

DESCRIPTION OF THE EMBODIMENTS

Example embodiments of the present disclosure are described below with reference to the accompanying drawings. Note that basically, the dimensions, materials, shapes, and relative positions of components described in the embodiments should be appropriately changed according to the configuration and various conditions of the apparatus to which the present disclosure is applied. The embodiments described below are not intended to limit the scope of the present disclosure.

In addition, unless otherwise noted, according to the present example embodiment, the rotational axis of an image bearing member, the rotational axis of a developer bearing member, and the rotational axis of a sealing unit (all are describe below) are substantially parallel to one another. Furthermore, the longitudinal directions are substantially the same as the directions of the rotation axes.

First Example Embodiment

Figure 1:
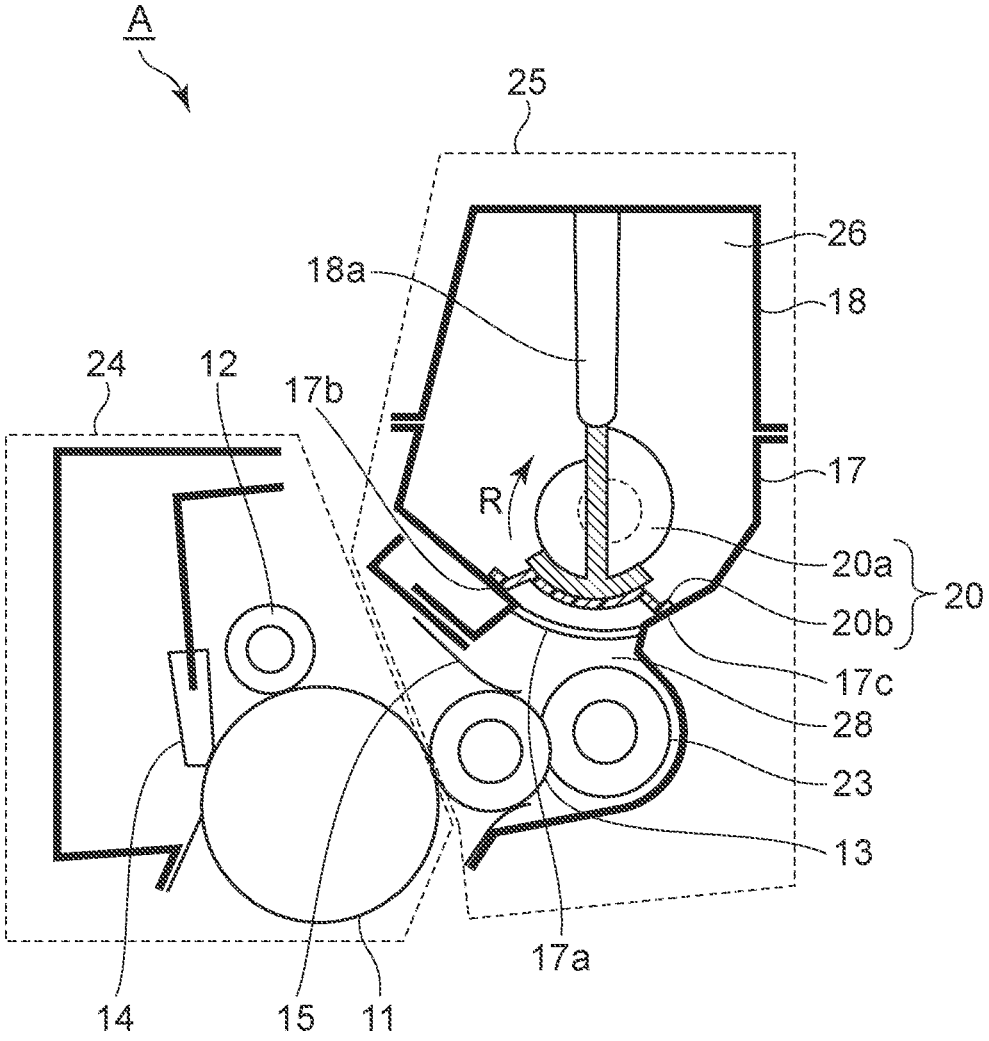
FIG. 1 is a cross-sectional view of an example process cartridge including a developer container unit according to an example embodiment of the present disclosure.
Figure 2:
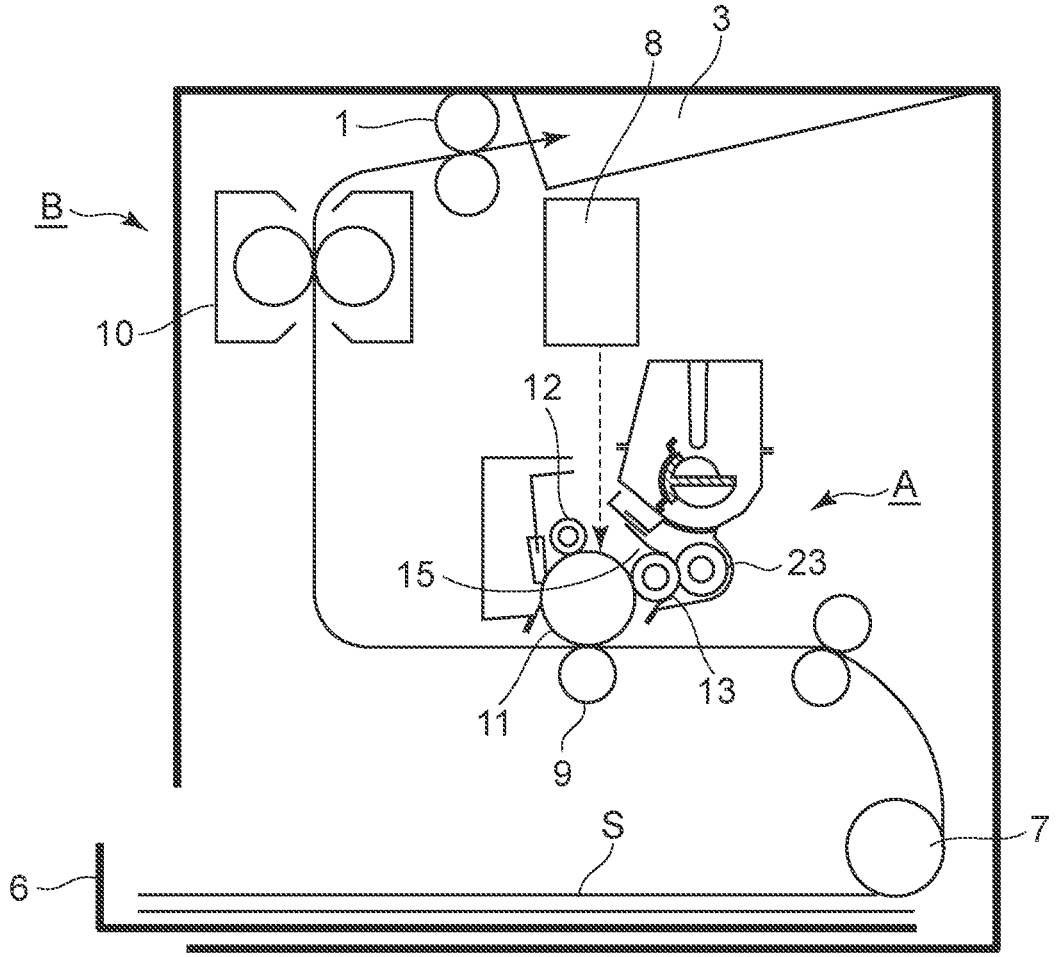
FIG. 2 is a cross-sectional view of an example image forming apparatus according to an embodiment of the present disclosure.

FIG. 1 is a cross-sectional view of a process cartridge including a developer container unit according to the present disclosure. FIG. 2 is a cross-sectional view of an image forming apparatus according to the present disclosure. FIGS. 1 and 2 illustrate the cross sections obtained by cutting the developer container unit and the image forming apparatus in a plane orthogonal to the above-described rotation axes as viewed in the rotation axes, respectively.

Overview of Configuration of Example Process Cartridge

The process cartridge includes the image bearing member and a process unit acting on the image bearing member. Examples of a process unit include a charging unit for charging the surface of the image bearing member, a developing apparatus for forming an image on the image bearing member, and a cleaning unit for removing a developer (including toner and a carrier) remaining on the surface of the image bearing member.

According to the present example embodiment, a process cartridge A includes a photosensitive drum 11 serving as a rotatable image bearing member. The photosensitive drum 11 bears an electrostatic latent image on the surface thereof. The process cartridge A includes a charging roller 12 serving as a charging member for charging the surface of the photosensitive drum 11. The charging roller 12 is rotatable. The process cartridge A includes a cleaning blade 14 serving as a cleaning member for cleaning the surface of the photosensitive drum 11.

According to the present example embodiment, the process cartridge A includes a developing roller 13 that bears toner, which is a developer, and that serves as a rotatable developer bearing member. The developing roller 13 supplies toner to the photosensitive drum 11 to develop the electrostatic latent image formed on the photosensitive drum 11. The process cartridge A includes a developer supply roller 23 serving as a rotatable supply member for supplying toner to the developing roller 13. The developer supply roller 23 is in contact with the developing roller 13 and supplies toner to the developing roller 13. The process cartridge A includes a developing blade 15 serving as a regulation member for regulating the thickness of the toner born by the developing roller 13.

According to the present example embodiment, the process cartridge A includes a photosensitive unit 24 and a developing apparatus. The photosensitive unit 24 includes the photosensitive drum 11, the charging roller 12, and the cleaning blade 14. The developing apparatus includes the developing roller 13, the developer supply roller 23, and the developing blade 15.

As illustrated in FIG. 1, the process cartridge A according to the present example embodiment includes, around the photosensitive drum 11 serving as an image bearing member, the charging roller 12 serving as a charging unit and the photosensitive unit 24 including the cleaning blade 14 that has elasticity and that serves as a cleaning unit. The process cartridge A further includes the developer container unit 25 having a first frame 17 and a second frame 18. In the process cartridge A, the photosensitive unit 24 and the developer container unit 25 are integrated into one unit, and the process cartridge A is configured so as to be removable from an apparatus main body B of the image forming apparatus, as illustrated in FIG. 2. The developer container unit 25 is provided with a developer containing chamber 26 for containing toner.

The developing roller 13 and the developing blade 15 are supported by the first frame 17. That is, according to the present example embodiment, the developer container unit 25 is a part of the developing apparatus. In other words, the developing apparatus according to the present example embodiment includes the developer container unit 25 and the developing roller 13. In addition, the developer container unit 25 according to the present example embodiment is a part of the process cartridge A. In other words, the process cartridge A according to the present example embodiment includes the photosensitive drum 11, the developing roller 13, and the developer container unit 25. Furthermore, according to the present example embodiment, the developer container unit 25 is removable from the apparatus main body B of the image forming apparatus.

Overview of Configuration of Image Forming Apparatus

As illustrated in FIG. 2, the process cartridge A is mounted in the apparatus main body B of the image forming apparatus. The image forming apparatus performs an image forming operation on a recording material by using the process cartridge A. During the image forming operation, the photosensitive drum 11 is charged by the charging roller 12. In addition, the apparatus main body B conveys a sheet S serving as a recording material from a sheet cassette 6 by using the conveyance roller 7. In synchronization with sheet conveyance, an exposure apparatus 8 selectively exposes the charged photosensitive drum 11 to form a latent image (an electrostatic latent image) on the photosensitive drum 11. Toner is supplied to the developing roller 13 (the developer bearing member) by the sponge-like developer supply roller 23. The toner supplied onto the surface of the developing roller 13 is born on the surface of the developing roller 13 in the form of a thin layer by the developing blade 15. Thereafter, a developing bias is applied to the developing roller 13 and, thus, toner is supplied onto the electrostatic latent image on the photosensitive drum 11. In this manner, a developer image (a toner image) is formed on the surface of the photosensitive drum 11. The toner image is transferred onto the sheet S by a transfer bias applied to a transfer roller 9. The sheet S is conveyed to a fixing device 10 and is heated. In this manner, the toner image is fixed onto the sheet S. The sheet S is discharged by a discharge roller 1 to a discharge portion 3 at the top of the apparatus.

Configuration of Example Developer Container Unit

Figure 3:
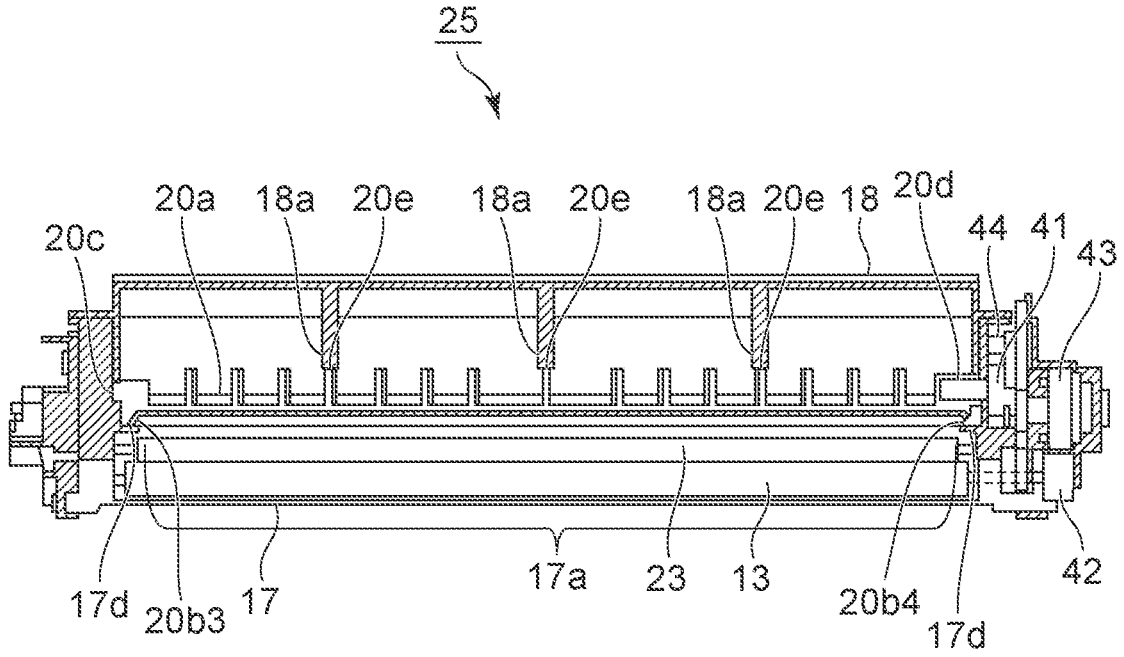
FIG. 3 is a cross-sectional view of an example developer container unit according to an embodiment of the present disclosure.
Figure 4:
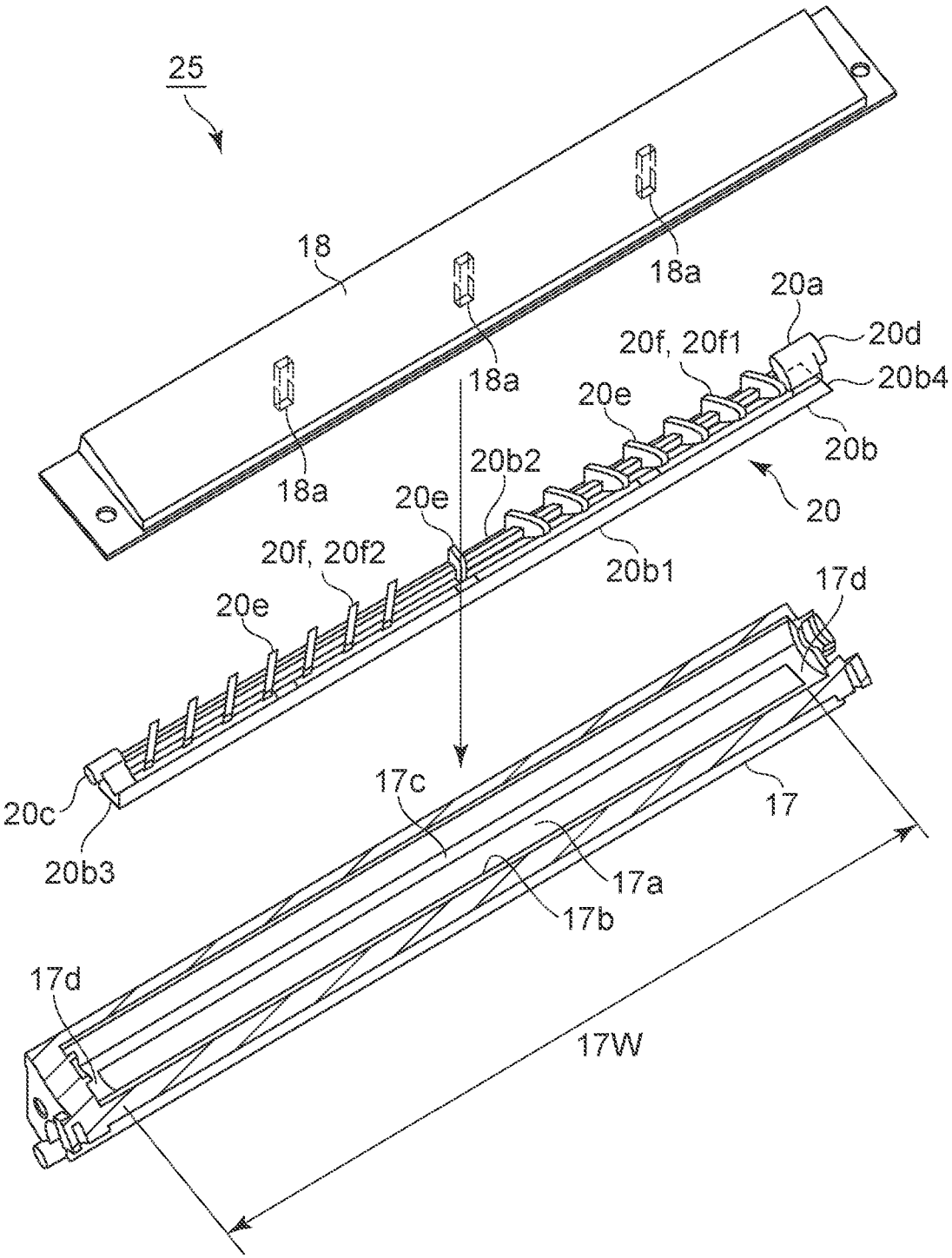
FIG. 4 is a perspective view illustrating the assembly of the developer container unit according to the embodiment of the present disclosure.

The configuration of the developer container unit 25 is described below with reference to FIGS. 1, 3 and 4. FIG. 3 is a cross-sectional view of the developer container unit 25. FIG. 4 is a perspective view illustrating the assembly operation of the developer container unit 25. Note that FIG. 3 illustrates the cross section obtained by cutting the developer container unit 25 in a plane extending along the rotational axis of the developing roller 13, as viewed in a direction orthogonal to the rotational axis.

Hereinafter, the direction orthogonal to the longitudinal direction is defined as a "transverse direction".

As illustrated in FIG. 1, the developer container unit 25 includes a single developing frame (a frame) formed by combining the first frame 17, which supports the developing roller 13 and the developing blade 15, with the second frame 18. According to the present example embodiment, the first frame 17 and the second frame 18 are part of the developing frame. The developing frame is provided with the developer containing chamber 26 formed therein. The first frame 17 is provided with an opening 17*a* for discharging the toner stored in the developer containing chamber 26 from the developer containing chamber 26. The opening 17*a* extends in the longitudinal direction. That is, the frame formed by the first frame 17 and the second frame 18 is provided with the developer containing chamber 26 and the opening 17*a*.

A sealing unit 20 is provided in the developer containing chamber 26. The sealing unit 20 closes the opening 17*a*. The sealing unit 20 has a shape extending along the opening 17*a* in the longitudinal direction. The sealing unit 20 has a sealing portion 20*b* for sealing the opening 17*a* and a shaft member 20*a* for supporting the sealing portion 20*b*. According to the present example embodiment, the scaling portion 20*b* and the shaft member 20*a* are integrated into one body. The sealing portion 20*b* has elasticity. As illustrated in FIG. 3, shaft portions 20*c* and 20*d* are provided at either end of the shaft member 20*a* and are rotatably supported by the first frame 17. In addition, an unsealing gear 41 is coupled with the shaft portion 20*d* at one end of the shaft member 20*a* (the right end in FIG. 3). The unsealing gear 41 rotates along with the rotation of the sealing unit 20. That is, according to the present example embodiment, the shaft member 20*a* is supported by the unsealing gear 41 and the first frame 17. A portion of the unsealing gear 41 and a portion of the first frame 17 for supporting the shaft member 20*a* can also be referred to as a "support portion". The unsealing gear 41 meshes with an intermediate gear 44. The intermediate gear 44 meshes with an input gear 43. The input gear 43 receives a driving force from the apparatus main body B. The intermediate gear 44 transfers, to the unsealing gear 41, the driving force received from the apparatus main body B. The sealing portion 20*b* is pressed against the first frame 17 by the shaft member 20*a* and is compressed so as to seal the opening 17*a*. That is, when the sealing portion 20*b* seals the opening 17*a*, the sealing portion 20*b* is compressed around the opening 17*a* between the first frame 17 and the shaft member 20*a*. According to the present example embodiment, the compressed state of the sealing portion 20*b* refers to a state in which a lip (described below) is deformed so as to expand from the inside to the outside of the opening 17*a*. When being pressed against the shaft member 20*a*, the sealing portion 20*b* is brought into contact with the periphery of the opening 17*a*. That is, according to the present example embodiment, the sealing portion 20*b* can seal the opening 17*a* without being welded to the first frame 17.

When the process cartridge A is shipped, the sealing unit 20 is located at a position at which the opening 17*a* is sealed by the sealing portion 20*b* (a close position), as illustrated in FIG. 1. Thereafter, when the sealing unit 20 is used, the input gear 43 is given the driving power (the driving force) from the apparatus main body B and is rotated. Thus, the sealing unit 20 is rotated in the direction of arrow R in FIG. 1, and the opening 17*a* is unsealed. The configuration of the sealing unit 20 is described in more detail below.

In addition, the developing roller 13 and the developer supply roller 23 for supplying toner to the developing roller 13 are provided outside of the developer containing chamber 26. Each of the developing roller 13 and the developer supply roller 23 is rotatably supported by the first frame 17 at both ends thereof in the longitudinal direction. One end of the developing roller 13 in the longitudinal direction has a developing gear 42 coupled thereto. The developing gear 42 is meshed with the input gear 43. Similarly, one end of the developer supply roller 23 has a gear (not illustrated) coupled thereto. The gear is meshed with the input gear 43. When the input gear 43 rotates, the developing roller 13 and the developer supply roller 23 rotate along with the rotation of the unsealing gear 41. As used herein, as illustrated in FIG. 1, a portion where the developing roller 13 and the developer supply roller 23 are provided is referred to as a "developing chamber 28". That is, the frame of the developer container unit 25 includes the developing chamber 28. The toner stored in the developer containing chamber 26 is supplied to the developing chamber 28 through the opening 17*a*. In other words, the toner is discharged from the developer containing chamber 26 toward the developing chamber 28 through the opening 17*a*.

Furthermore, as illustrated in FIGS. 3 and 4, in the second frame 18, a plurality of rib-shaped pressing portions (regulating portions) 18*a* protrude downward from the inner top surface of the second frame 18 toward the opening 17*a*. The pressing portions 18*a* are provided at positions facing the opening 17*a*. When the sealing unit 20 is in a sealing posture (a closing position), the pressing portions 18*a* are in contact with to-be-pressed portions (regulated portions) 20*e* of the shaft member 20*a* of the sealing unit 20. According to the present example embodiment, the pressing portions 18*a* are convex portions provided on the second frame 18, and the to-be-pressed portions 20*e* are concave portions that receive the pressing portions 18*a*. The function of the pressing portions 18*a* is described in detail below.

Detailed Configuration of Example Sealing Unit

Figure 5A:
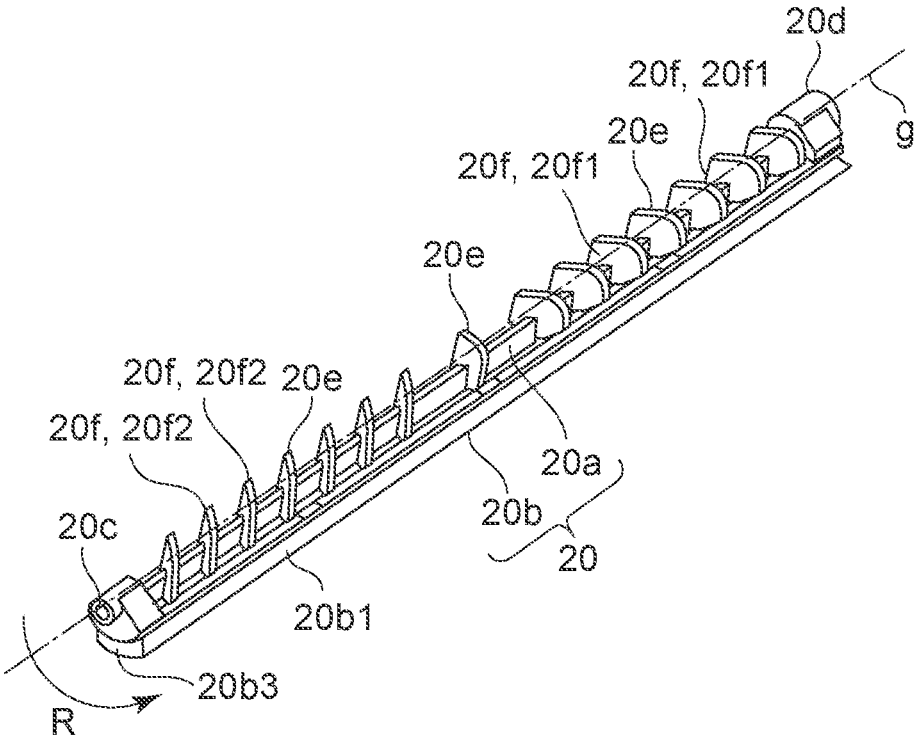
FIGS. 5A and 5B are perspective views of an example sealing unit according to the embodiment of the present disclosure.
Figure 5B:
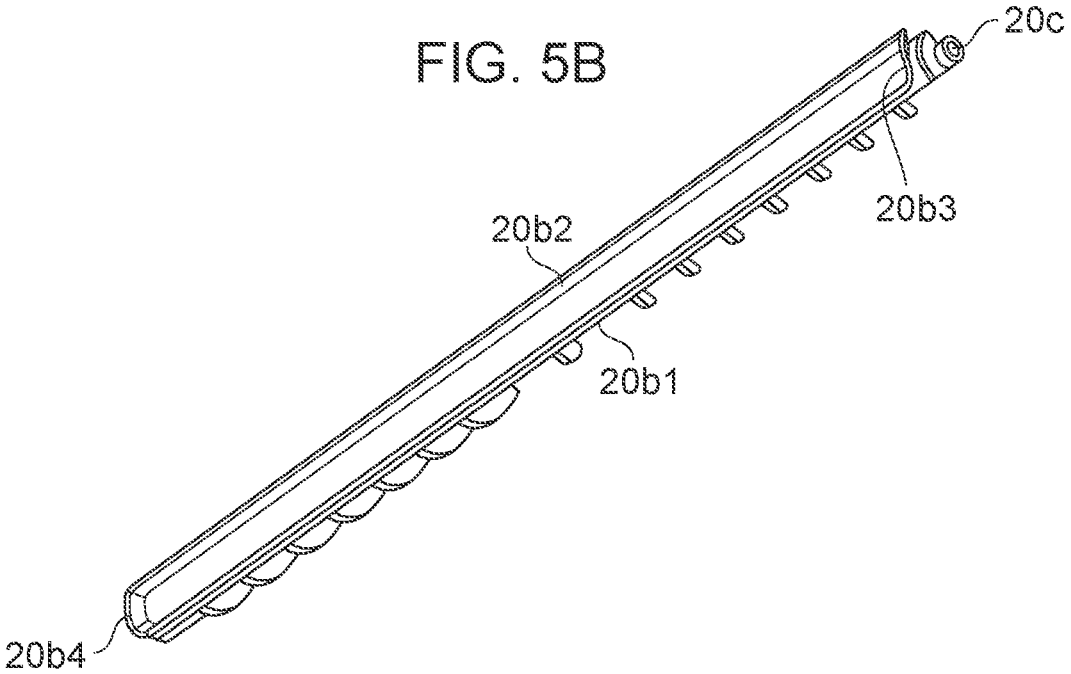
Figure 6A:
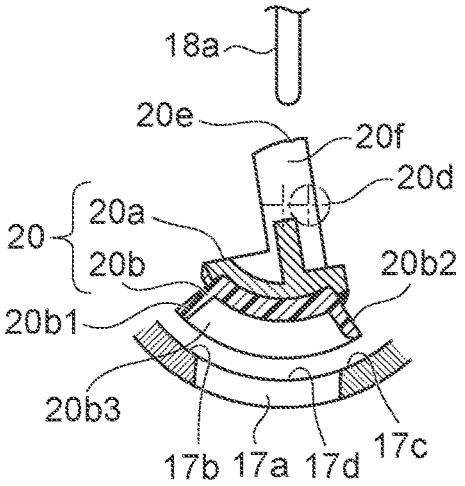
FIGS. 6A to 6E are cross-sectional views of the sealing unit according to the embodiment of the present disclosure.
Figure 6B:
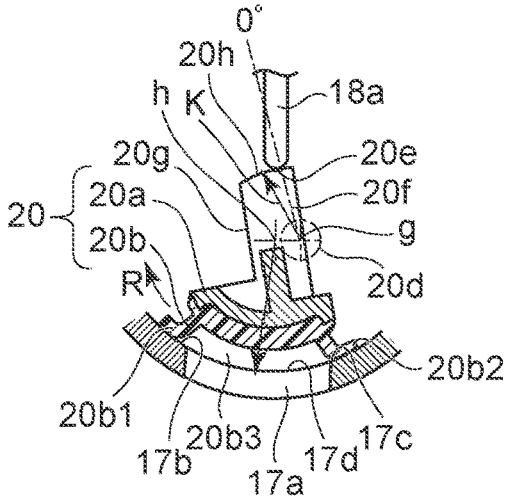
Figure 6C:
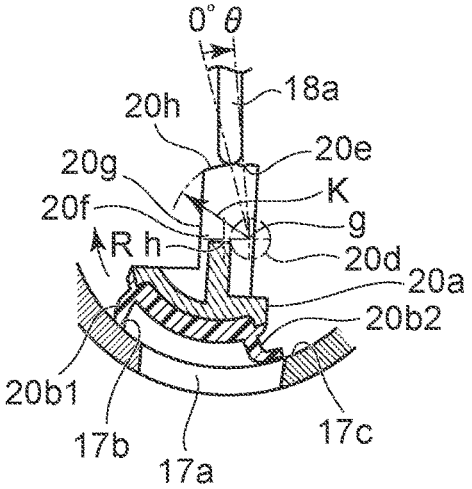
Figure 6D:
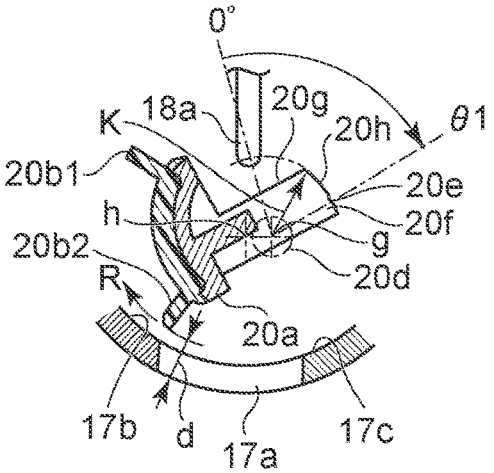
Figure 6E:
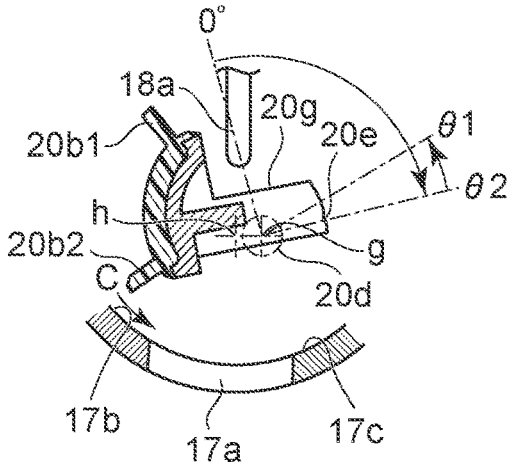
Figure 11:
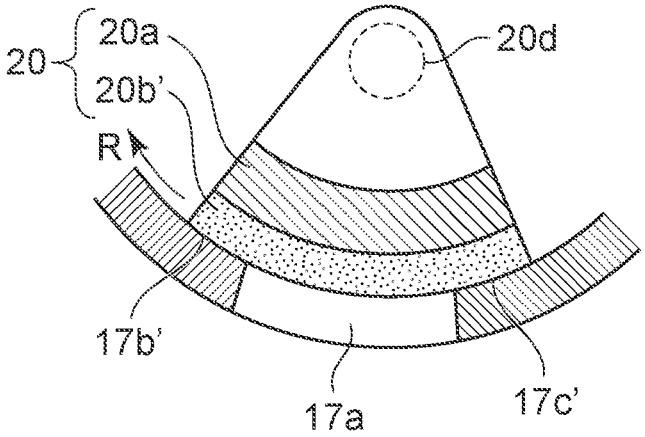
FIG. 11 is a cross-sectional view illustrating another form of a sealing unit according to an embodiment of the present disclosure.

The detailed configuration of the sealing unit 20 is described below with reference to FIGS. 5A and 5B, FIGS. 6A to 6B, and FIG. 11. FIGS. 5A and 5B are perspective views of the sealing unit 20. FIGS. 6A to 6E are cross-sectional views of the sealing unit 20. FIG. 6A illustrates the sealing unit 20 before the sealing unit 20 is incorporated into the developer containing chamber 26, and FIG. 6B illustrates the sealing unit 20 after the sealing unit 20 is incorporated into the developer containing chamber 26. FIGS. 6C to 6E illustrate the unsealing operation performed by the sealing unit 20. FIG. 11 is a cross-sectional view of another form of a sealing unit.

As described above, the sealing unit 20 includes the shaft member 20*a* and the sealing portion 20*b* having elasticity. When the sealing unit 20 is in a sealing mode (refer to FIG. 6B), the sealing unit 20 is supported by the first frame 17 at a position at which the sealing portion 20*b* is slightly deformed. Accordingly, as illustrated in FIG. 4, the sealing portion 20*b* is sandwiched between the entire periphery of the opening 17*a* (i.e., a to-be-contacted portion 17*b*, a to-be-contacted portion 17*c*, and to-be-contacted portions 17*d*) and the shaft member 20*a* and, thus, the sealing portion 20*b* is elastically deformed. In this manner, the sealing unit 20 is continuously sealed. As used herein, the position of the sealing unit 20 at which the sealing portion 20*b* seals the opening 17*a* is referred to as a "close position". According to the present example embodiment, when the sealing unit 20 is in the close position, the sealing portion 20*b* is in contact with the first frame 17 around the opening 17*a* so as to surround the opening 17*a*. When the sealing unit 20 is in the close position, the sealing portion 20*b* is pressed against the first frame 17 around the opening 17*a* by the shaft member 20*a* and is compressed.

As illustrated in FIG. 11, as the sealing portion 20*b*, a strip-shaped sponge 20*b*' may be bonded to the shaft member 20*a* so as to be integrated with the shaft member 20*a*. However, according to the present example embodiment, as typically illustrated in FIGS. 6A to 6E, the sealing portion 20*b* made of elastomer is integrally formed on the shaft member 20*a* to form the sealing unit 20. In this manner, the need for the process of coupling the sealing portion 20*b* with the shaft member 20*a* is eliminated. In addition, the sealing portion 20*b* has a lip (a protrusion) that protrudes in a direction orthogonal to the rotational axis of the shaft member 20*a*. As illustrated in FIG. 5B, the lip of the sealing portion 20*b* is formed along an elongated rectangle and has long sides 20*b*1 and 20*b*2 and short sides 20*b*3 and 20*b*4. The long sides 20*b*1 and 20*b*2 and the short sides 20*b*3 and 20*b*4 are formed so as to surround the outer periphery of the opening 17*a* when the sealing unit 20 is in the sealing posture (the closing position). The short sides 20*b*3 and 20*b*4 located at either end of the sealing portion 20*b* in the longitudinal direction have shapes following the circular arc shapes of the contacted portions 17*d* that are located in the outer periphery of the opening 17*a* and that extend in the transverse direction.

Corner portions where each of the long sides 20*b*1 and 20*b*2 of the sealing portion 20*b* intersects each of the short sides 20*b*3 and 20*b*4 are connected by circular arc portions of the sealing portion 20*b*. In addition, as illustrated in FIG. 6A, the tip of the lip has a shape which is inclined from the inside to the outside of the opening 17*a* around the entire periphery. As illustrated in FIG. 6B, when the sealing unit 20 is incorporated into the developer containing chamber 26, the sealing portion 20*b* is deformed (inclined) so as to spread from the inside to the outside of the opening 17*a* around the entire periphery. In this manner, the sealing unit 20 can be brought into contact with an inner wall surface of the first frame 17. As a result, the sealing unit 20 can be easily assembled. In addition, the sealing unit 20 can have stable sealing performance.

If the tip of the lip stands upright from the shaft member 20*a*, the direction in which the tip of the lip bends is uncertain when the sealing unit 20 is assembled. Thus, the toner may leak through a gap formed by the irregularly bent portion. Furthermore, since the tip of the lip of the sealing portion 20*b* is directed outward, the tip of the lip is pressed against the to-be-contacted portions 17*b*, 17*c* and 17*d* by the toner powder pressure in the developer containing chamber 26. Consequently, the sealing performance is better than that of the structure in which the tip of the lip is directed inward.

In addition, as illustrated in FIG. 6A, in the shaft member 20*a*, the to-be-pressed portion 20*e* is provided for each of the pressing portions 18*a* at a position opposite to the sealing portion 20*b*. The pressing portion 18*a* is provided at a position where the pressing portions 18*a* is in contact with the to-be-pressed portion 20*e* and, thus, the sealing portion 20*b* maintains a sealing posture in which the sealing portion 20*b* is slightly deformed (refer to FIG. 6B). By setting the pressing portions 18*a* in this manner, a sealing performance deterioration caused by bend of the shaft member 20*a* due to elasticity of the sealing portion 20*b* can be prevented in an inner side portion of the sealing portion 20*b* in the longitudinal direction. In addition, when the sealing unit 20 is in the close position, the pressing portion 18*a* is in contact with the to-be-pressed portion 20*e* so as to restrict the rotation of the sealing unit 20. As a result, toner leakage through the opening 17*a* can be prevented which is caused by deformation of the sealing unit 20 due to, for example, vibration generated when the process cartridge A is carried. Furthermore, by providing the pressing portion 18*a*, the bending rigidity of the shaft member 20*a* can be reduced more than in the case where the pressing portion 18*a* is not provided. In this case, since the shaft member 20*a* is easily deformed when the pressing portion 18*a* is come off from the to-be-pressed portion 20*e*, the compression of the scaling portion 20*b* is easily released. Furthermore, the amount of the material of the shaft member 20*a* can be reduced, and the weight of the shaft member 20*a* can be reduced. Note that while the present example embodiment has been described with reference to the three pressing portions 18*a*, the number of the pressing portions 18*a* can be appropriately selected depending on the rigidity of the shaft member 20*a* and the elasticity of the sealing portion 20*b*.

As illustrated in FIG. 6B, if the sealing unit 20 receives vibration from the main body, the sealing unit 20 rotates in the direction of arrow R about a rotational axis g extending between the shaft portions 20*c* and 20*d* at both ends. That is, the rotational axis g is the rotational axis of the shaft member 20*a*. At the same time, the rotational axis g is the rotational axis of the sealing unit 20. According to the present example embodiment, the direction of the rotational axis (the axial direction) g is the same as (parallel to) the longitudinal direction.

The shaft member 20*a* of the sealing unit 20 is disposed above the opening 17*a* in the gravitational force direction. In addition, as viewed in the direction of the rotational axis g, the position of the rotational axis g overlaps the position of the opening 17*a* in the horizontal direction. As a result, the toner can easily flow into the opening 17*a* by the reciprocation operation performed by the sealing unit 20 (described below).

A reed-shaped sponge 20*b*' illustrated in FIG. 11 can be used as the sealing portion 20*b*. Upon starting unsealing, the sponge 20*b*' is in slide contact with to-be-contacted portions 17*b*' and 17*c*' while being compressed. In contrast, according to the lip configuration illustrated in FIGS. 6A to 6E, as illustrated in FIG. 6C, the tip of the lip of a sealing portion 20*b*1 on the downstream side in the rotational direction R swings backward (inward) without moving from the position at which the tip is in contact with the to-be-contacted portion 17*b*. Thereafter, the tip of the lip slides on the to-be-contacted portion 17*b* while maintaining the swing-back posture. Consequently, the load required for the unsealing operation can be reduced more than that of the structure having a reed-shaped sealing portion 20*b* (FIG. 11).

As illustrated in FIG. 6C, it is desirable that a concave circular arc shape that matches the convex circular arc shape of the pressing portion 18*a* be formed on the to-be-pressed portion 20*e*. In this manner, the phase of the sealing unit 20 is stabilized when the sealing unit 20 is assembled. In addition, shifting of the sealing unit 20 in the circumferential direction caused by vibration generated during physical distribution can be prevented. Note that if the pressing portions 18*a* are in contact with the to-be-pressed portions 20*e* at the close position and, thus, deformation of the shaft member 20*a* is prevented, the shapes of the pressing portion 18*a* and the to-be-pressed portion 20*e* are not limited to the above-described shapes.

The to-be-pressed portion 20*e* has a recess portion 20*g* formed upstream of the pressing portion 18*a* in the rotational direction R. The recess portion 20*g* retracts inward in a direction of the rotation radius K of the to-be-pressed portion 20*e* so as not to be in contact with the pressing portions 18*a*. If the sealing unit 20 rotates in the direction of arrow R, the to-be-pressed portion 20*e* is separated from the pressing portion 18*a*. When the recess portion 20*g* reaches the position of the pressing portion 18*a*, the shaft member 20*a* is warped in a direction away from the scaling portion 20*b* by the reaction force of the elasticity of the sealing portion 20*b*. In this manner, the pressure with which the sealing portion 20*b* urges against the periphery of the opening 17*a* decreases at the inner side (the center portion) in the longitudinal direction. As a result, the unsealing load is reduced. Upon receiving the driving power from the apparatus main body, the sealing unit 20 is moved from the close position illustrated in FIG. 6B to a first open position by being rotated through a predetermined angle θ1 (hereinafter referred to as an "unsealing angle") in the direction of arrow R, as illustrated in FIG. 6D. Through such an operation, the unsealing operation is performed. As used herein, the direction in which the sealing unit 20 rotates from the close position toward the first open position is referred to as an "unsealing direction". As illustrated in FIG. 6E, the sealing unit 20 does not stay in the first open position and continuously rotates through a second predetermined angle θ2 (hereinafter referred to as a "maximum angle") in the direction of the arrow R, from the close position to a second open position at which the sealing unit 20 is not in contact with the pressing portion 18*a*. When the sealing unit 20 is located at the first open position or the second open position, the opening 17*a* is open. That is, the toner can be discharged through the opening 17*a*. Upon reaching the second open position, the sealing unit 20 swings backward and returns to the first open position. Thereafter, similarly, the sealing unit 20 continuously repeats a reciprocating motion (a pivotal movement) between the first open position and the second open position. This reciprocating motion is continued even during the image forming operation in which an image is formed on a recording material. Thus, the toner is stirred by the sealing unit 20, and the discharge of the toner from the opening 17*a* is facilitated. In addition, during the reciprocating motion, the pressing portion 18*a* is separated from the to-be-pressed portion 20*e*. According to the present example embodiment, the drive configuration is set such that the unsealing angle θ1 is 77 degrees and the maximum angle θ2 is 95 degrees. The above-described operation performed by the sealing member is available by using, for example, a link mechanism. However, according to the present example embodiment, the operation is carried out by using a partially toothed gear and a spring. The unsealing angle θ1 and the maximum angle θ2 can be set to any values depending on the specifications of the gear. The drive configuration is described in more detail below.

The amount by which the sealing portion 20*b* is compressed in the direction orthogonal to the rotational axis g while the sealing unit 20 executes the reciprocating motion is smaller than that when the sealing unit 20 is located at the close position. As used herein, a partial area of the shaft member 20*a* in which the sealing portion 20*b* is attached is referred to as a "attaching surface". The distance between the attaching surface and the inner wall surface of the first frame 17 in a direction orthogonal to the rotational axis g when the sealing unit 20 executes the reciprocating motion is longer than that when the sealing unit 20 is in the close position. In this manner, when the sealing unit 20 executes the reciprocating motion, the load produced by compression of the sealing portion 20*b* can be reduced. According to the present example embodiment, while the sealing unit 20 executes the reciprocating motion, the sealing portion 20*b* is separated from the inner wall surface of the first frame 17. That is, the sealing portion 20*b* is not compressed. In this way, when the sealing unit 20 executes the reciprocating motion, the load produced by compression of the sealing portion 20*b* is eliminated. At the same time, the operation to discharge the toner through the opening 17*a* is not prevented by the sealing portion 20*b*.

As illustrated in FIG. 5A, the shaft member 20*a* includes a feeding blade 20*f* including a plurality of ribs 20*f*1 and 20*f*2 on the side remote from the sealing portion 20*b*. The ribs 20*f*1 and the ribs 20*f*2 correspond to an inclined portion. The ribs 20*f*1 and the ribs 20*f*2 are inclined at 45 degrees with respect to the rotational axis g extending between the shaft portions 20*c* and 20*d*. Note that the inclination directions of the ribs 20*f*1 are changed from those of the ribs 20*f*2 at the midpoint of the shaft member 20*a* in the longitudinal direction. The sealing unit 20 executes a reciprocating motion between the first open position and the second open position and, thus, the ribs 20*f*1 and the ribs 20*f*2 mixes the toner in the developer containing chamber 26. At this time, even when the toner is shifted to one side of the developer containing chamber 26 in the longitudinal direction, the ribs 20*f*1 and the ribs 20*f*2 can put the toner back in place.

As described above, the sealing unit 20 according to the present example embodiment can seal the opening 17*a* without being welded to the first frame 17. In addition, according to the configuration of the present example embodiment, to cause the sealing unit 20 to function as an agitating member during an image forming operation, the sealing unit 20 is made to execute reciprocating motion. If the sealing member having the elastic sealing portion 20*b* continues to rotate in one direction, the sealing unit 20 interferes with the pressing portion 18*a*. For this reason, it is difficult to provide the pressing portion 18*a*. However, since the sealing unit 20 executes a reciprocating motion, the pressing portion 18*a* can be provided. Moreover, since the sealing portion 20*b* of the sealing unit 20 is not welded to the first frame 17, the load required for peeling off a welding portion when the opening 17*a* is unsealed is eliminated. That is, the load of the unsealing operation performed by the sealing unit 20 can be reduced.

In addition, in the case of a configuration in which a sheet-shaped seal is welded to the frame, it is necessary to make the welding surface, that is, the surface around the opening 17*a* flat to obtain the welding stability. In contrast, according to the present configuration, such limitation is not needed. Consequently, according to the present configuration, the peripheral surface of the opening 17*a* can be an inclined surface which is inclined downward in the gravitational force direction toward the opening 17*a*. Alternatively, the peripheral surface can be a circular arc surface. In this manner, the toner around the opening 17*a* easily fall toward the opening 17*a*.

In addition, if the sealing unit 20 having the sealing portion 20*b* to be compressed continues to rotate in one direction, the sealing unit 20 repeatedly reaches the close position. Accordingly, the sealing portion 20*b* is repeatedly compressed and, thus, the load for rotating the sealing unit 20 increases. Furthermore, when the sealing unit 20 reaches the close position, the toner discharge operation from the opening 17*a* is interfered. According to the present example embodiment, the reciprocating motion of the sealing unit 20 avoids the occurrence of the above problem.

When the sealing unit 20 moves from the close position toward the first open position, the sealing portion 20*b* moves in contact with part of the inner wall surface of the first frame 17. The part of the inner wall surface is referred to as a "contact wall". In the orthogonal direction that is orthogonal to the rotational axis g, the distance between the contact wall and the rotational axis g increases toward the downstream side in the unsealing direction. More specifically, according to the present example embodiment, as described above, the shaft member 20*a* is supported by part of the unsealing gear 41 and part of the first frame 17 serving as the support portion. The rotational axis g passes through the support portion (the part of the unsealing gear 41 and the part of the first frame 17). In the direction orthogonal to the rotational axis g, the distance between the above-mentioned contact wall and the support portion increases toward the downstream side in the unsealing direction.

That is, when the sealing unit 20 rotates in the unsealing direction, the distance between the attaching surface of the shaft member 20*a* on which the sealing portion 20*b* is attached and the contact wall increases. As a result, in the orthogonal direction that is orthogonal to the rotational axis g, the amount by which the sealing portion 20*b* is compressed decreases. That is, in the orthogonal direction that is orthogonal to the rotational axis g, the amount by which the sealing portion 20*b* is compressed when the sealing unit 20 is located downstream of the closing position in the unsealing direction is smaller than that when the sealing unit 20 is located at the close position.

According to the present example embodiment, as illustrated in FIG. 6B, the sealing portion 20*b* located at the close position is in contact with the to-be-contacted portions 17*b*, 17*c*, and 17*d*. When the sealing unit 20 rotates in the unsealing direction (the R direction), the sealing portion 20*b* is in contact with the to-be-contacted portions 17*b*, 17*c*, and 17*d*. According to the present example embodiment, the to-be-contacted portions 17*b*, 17*c* and 17*d* have circular arc shapes as viewed in the direction of the rotational axis g. The center point of the circular arc shapes is referred to as an "circular arc center point h". As illustrated in FIG. 6B, as viewed in the direction of the rotational axis g, the position of the rotational axis g differs from the position of the circular arc center point h. More specifically, the rotational axis g is provided at a position offset to the upstream of the circular arc center point h (the right side in FIG. 6B) by about 2 mm in the movement direction at the start of the unsealing operation performed by the sealing portion 20*b*.

According to such a configuration, when the opening 17*a* is unsealed, the sealing portion 20*b* is gradually moved away from the to-be-contacted portions 17*b*, 17*c* and 17*d* in the radial direction of the circular arc of the to-be-contacted portions 17*b*, 17*c* and 17*d*. If the circular arc center point h and the pivot center g coincide with each other (hereinafter, such a structure is referred to as a "concentric structure"), the sealing portion 20*b* of the sealing unit 20 that is moving toward the open position is compressed by the same amount as when the sealing unit 20 is located at the close position. For this reason, the load for moving the sealing unit 20 continues to be high. In contrast, according to the configuration of the present example embodiment, since the frictional load gradually decreases from the start of the unsealing operation, the load related to the unsealing operation can be gradually reduced from the start of the unsealing operation, as compared with the concentric structure. In addition, by setting the pivot center g as described above, the timing at which the sealing unit 20 that executes the reciprocating motion is separated from the bottom surface of the first frame 17 in the direction of a turning radius K can be advanced. Accordingly, a gap d (FIG. 6D) between the sealing unit 20 and the bottom surface of the first frame 17 can be increased. As a result, the toner in the developer containing chamber 26 can be smoothly discharged to the outside through the opening 17*a* without being blocked by the sealing unit 20. That is, it is possible to reduce the time from when the sealing unit 20 starts moving in the unsealing direction to when the toner flows from the downstream side of the opening 17*a* in the unsealing direction into the opening 17*a*. In addition, as compared with the configuration in which the sealing portion 20*b* is in slide contact with the inner surface of the frame, the stress related to the toner can be further reduced. In contrast, in the case of the concentric structure, the sealing unit 20 cannot be separated from the bottom surface of the first frame 17 until at least the long side 20*b*2 of the sealing portion on the downstream side in the rotational direction R reaches the to-be-contacted portion 17*b*. That is, to form the gap d between the sealing unit 20 and the bottom surface of the first frame 17, it is necessary to further pivot the sealing unit beyond the first open position.

Drive Configuration of Example Sealing Unit

Figure 7:
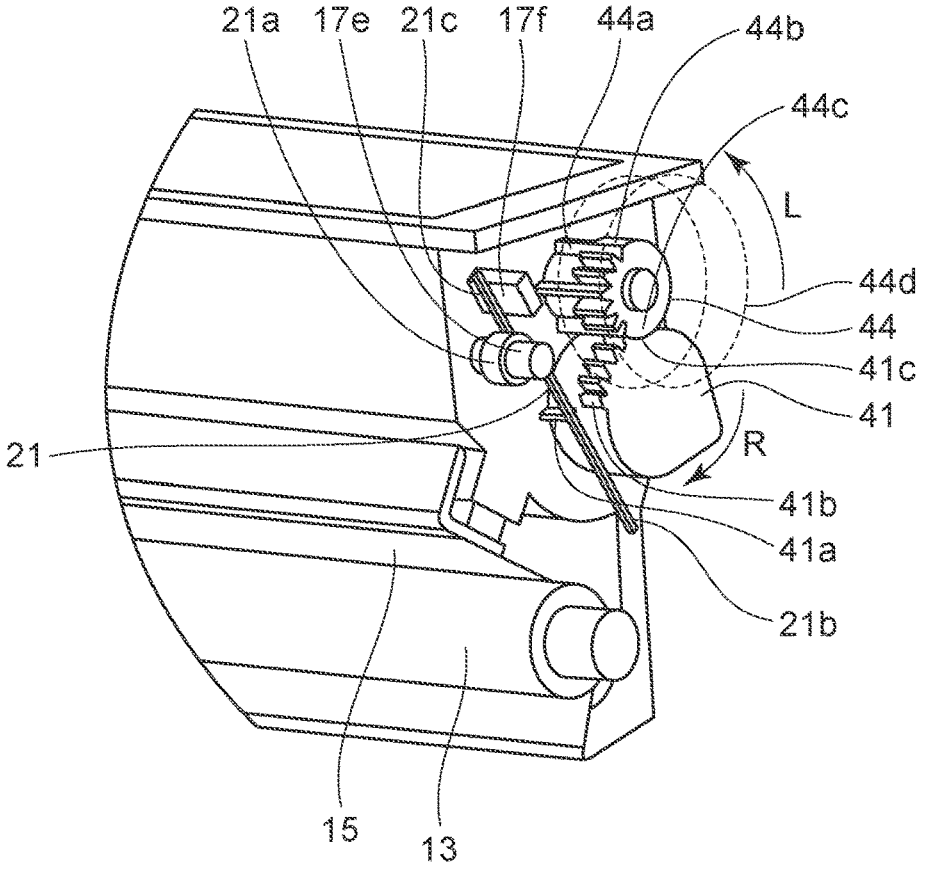
FIG. 7 is a perspective view of an example drive transmission portion for the sealing unit according to the embodiment of the present disclosure.
Figure 8:
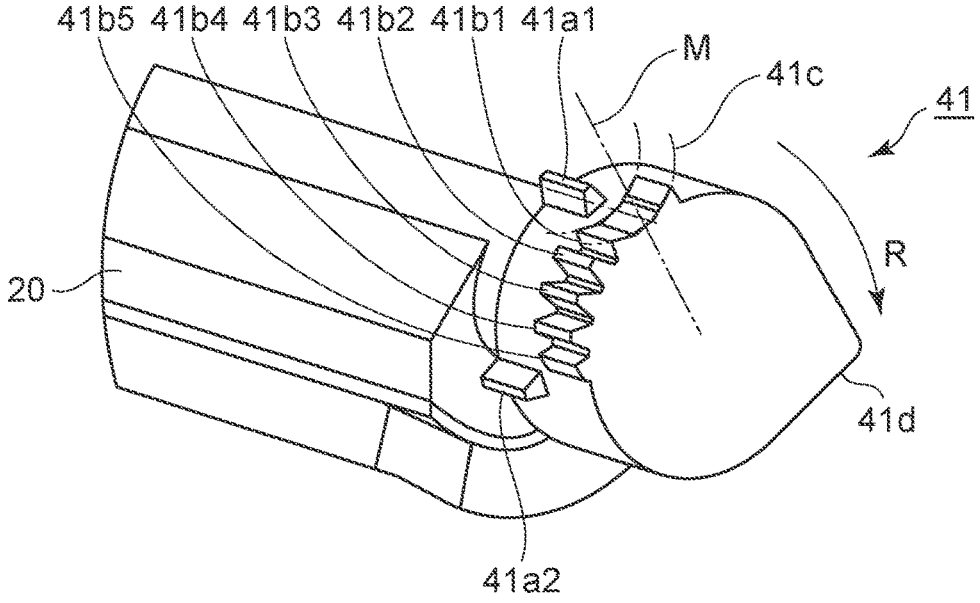
FIG. 8 is a perspective view of an unsealing gear according to the embodiment of the present disclosure.
Figure 9A:
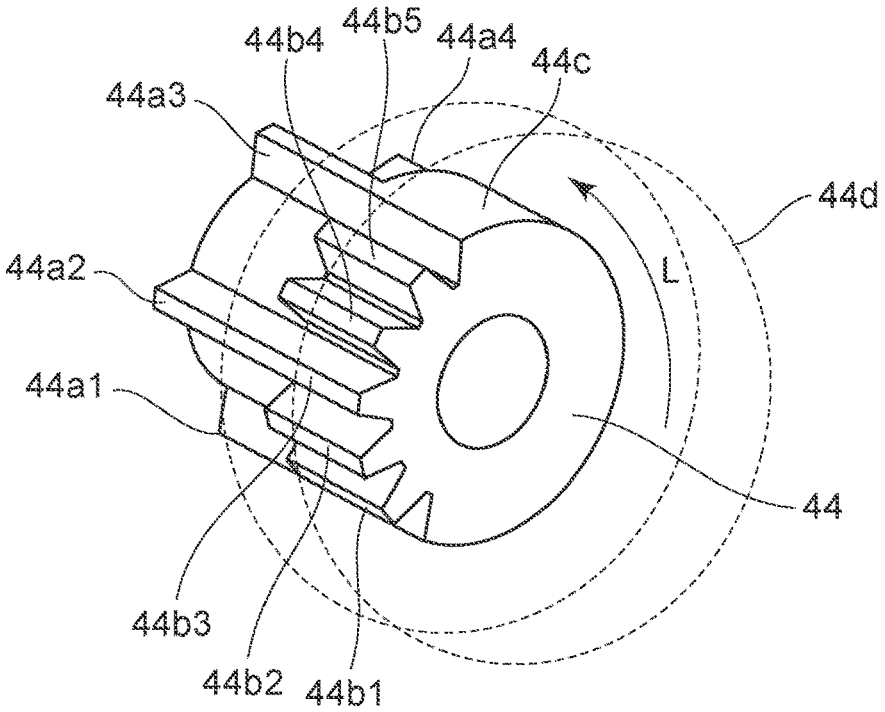
FIGS. 9A and 9B are perspective views of an intermediate gear according to the embodiment of the present disclosure.
Figure 9B:
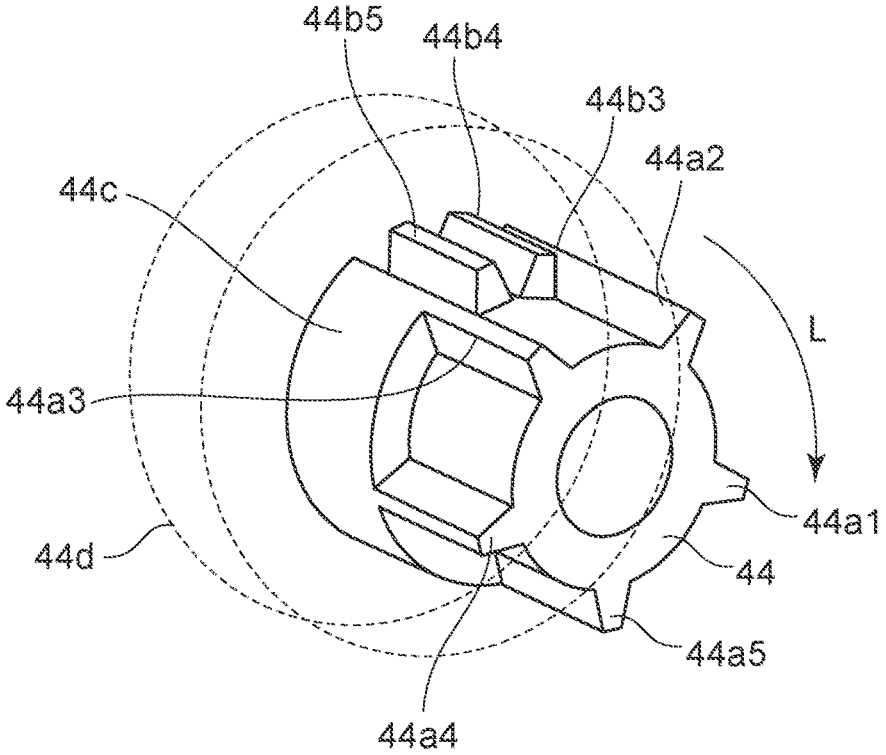

The operation performed by the sealing unit 20 is described below with reference to FIGS. 7 and 8, FIGS. 9A and 9B, and FIGS. 10A to 10F. FIG. 7 is a perspective view of a drive transmission portion for the sealing unit 20, and FIG. 8 is a perspective view of the unsealing gear 41. FIGS. 9A and 9B are perspective views of the intermediate gear 44, and FIG. 9B illustrates a view of FIG. 9A as viewed in the opposite direction. FIGS. 10A to 10F are cross-sectional views illustrating the sequence of the operations performed by the sealing unit 20.

The developer container unit 25 has the drive transmission portion for transmitting the driving force received from the apparatus main body B of the image forming apparatus to the sealing unit 20. The drive transmission portion includes the unsealing gear (a first transmission member) 41, the intermediate gear (a second transmission member) 44, and a biasing spring (a biasing member) 21. The unsealing gear 41 is coupled with the sealing unit 20. The intermediate gear 44 transmits the driving force received from the apparatus main body B of the image forming apparatus to the unsealing gear 41. According to the present example embodiment, the intermediate gear 44 transmits, to the unsealing gear 41, the driving force received from the apparatus main body B via the input gear 43.

As illustrated in FIG. 7, the unsealing gear (the first transmission member) 41 to be coupled with the sealing unit 20 is provided at an outer end of the first frame 17 in the longitudinal direction. As illustrated in FIG. 8, the unsealing gear 41 has a first unsealing gear portion 41*a* (41*a*1 and 41*a*2) and a second unsealing gear portion 41*b* (41*b*1 to 41*b*5) from the inner side close to the first frame 17 in the longitudinal direction. That is, the unsealing gear 41 is a gear known as a multistage gear, in which the first unsealing gear portion 41*a* and the second unsealing gear portion 41*b* are arranged in the axial direction.

The first unsealing gear portion 41*a* is a partially toothed gear, as illustrated in FIG. 8. If the first unsealing gear portion 41*a* is not a partially toothed gear, the number of teeth of the first unsealing gear portion 41*a* is 28. The actual first unsealing gear portion 41*a* is a partially toothed gear formed by removing, from the 28 teeth, all the teeth except for the teeth 41*a*1 and 41*a*2. The spacing between the teeth 41*a*1 and 41*a*2 corresponds to five teeth. The tooth 41*a*1 is located downstream of the tooth 41*a*2 in the rotational direction R of the unsealing gear 41. Hereinafter, the tooth 41*a*1 is referred to as a "leading tooth 41*a*1".

In addition, the second unsealing gear portion 41*b* is a partially toothed gear, as illustrated in FIG. 8. If the second unsealing gear portion 41*b* is not a partially toothed gear, the number of teeth of the second unsealing gear portion 41*b* is 28. The actual second unsealing gear portion 41*b* is a partially toothed gear formed by removing, from the 28 teeth, all the teeth except for the consecutive five teeth 41*b*1 to 41*b*5. The consecutive five teeth of the second unsealing gear portion 41*b* are disposed between the tooth 41*a*1 and the tooth 41*a*2 of the first unsealing gear portion 41*a* in the circumferential direction of the unsealing gear 41.

In addition, a circular arc concave portion 41*c* is provided downstream of the second unsealing gear portion 41*b* in the rotation direction R. As viewed in the longitudinal direction, the center point of the leading tooth 41*a*1 is located on a straight line M extending between the center point of the circular arc concave portion 41*c* and the pivot center of the unsealing gear 41. According to the present example embodiment, part of the circular are concave portion 41*c* coincides with the dedendum circle of the second unsealing gear portion 41*b*. This structure is employed to simplify the structure of a mold used for producing the unsealing gear 41. However, if as viewed in the longitudinal direction, circular arc shapes are formed at either end of the leading tooth 41*a*1, the circular arc concave portion 41*c* need not coincide with the dedendum circle.

As illustrated in FIGS. 9A and 9B, the intermediate gear 44 meshed with the unsealing gear 41 has a first intermediate gear portion 44*a* (44*a*1 to 44*a*5) meshed with the first unsealing gear portion 41*a* and a second intermediate gear portion 44*b* (44*b*1 to 44*b*5) meshed with the second unsealing gear portion 41*b*. The intermediate gear 44 includes a third intermediate gear portion 44*d* meshed with the input gear 43. The third intermediate gear portion 44*d* is not a partially toothed gear but a gear of a normal shape. For ease of understanding of the first intermediate gear portion 44*a* and the second intermediate gear portion 44*b*, the third intermediate gear portion 44*d* is denoted by a broken line in FIGS. 9A and 9B. That is, like the unsealing gear 41, the intermediate gear 44 is a gear known as a multistage gear.

The first intermediate gear portion 44*a* is a partially toothed gear. If the first intermediate gear portion 44*a* is not a partially toothed gear, the number of teeth of the first intermediate gear portion 44*a* is 15. The actual first intermediate gear portion 44*a* is a partially toothed gear formed by removing, from the 15 teeth, all the teeth except for the five teeth 44*a*1 and 44*a*5. The spacing between every adjacent two of the teeth 44*a*1 and 44*a*5 corresponds to two teeth.

The second intermediate gear portion 44*b* is a partially toothed gear. If the second intermediate gear portion 44*b* is not a partially toothed gear, the number of teeth of the second intermediate gear portion 44*b* is 15. The actual second intermediate gear portion 44*b* is a partially toothed gear formed by removing, from the 15 teeth, all the teeth except for the five consecutive teeth. The teeth removed portion is formed as a circular arc portion 44*c* having a radius equal to the radius of the addendum circle.

The operation performed by the sealing unit 20 when the input gear 43 receives a rotational drive power from the apparatus main body B and, thus, rotates is described with reference to FIGS. 10A to 10F. For ease of understanding, the third intermediate gear portion 44*d* is not illustrated in FIGS. 10A to 10F.

Figure 10A:
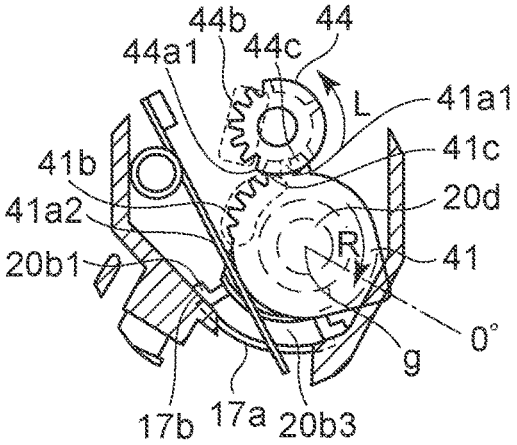
FIGS. 10A to 10F illustrate the operation performed by the sealing unit according to the embodiment of the present disclosure.

As illustrated in FIG. 10A, when the sealing unit 20 is in the sealing state (at the closing position), the circular arc concave portion 41*c* of the unsealing gear 41 is meshed with the circular arc portion 44*c* of the intermediate gear 44. At this time, the first intermediate gear portion 44*a* is separated from the leading tooth 41*a*1. That is, an accidental pivotal movement of the sealing unit 20 caused by, for example, vibration generated during transportation of the developer container unit 25 can be avoided.

Subsequently, the intermediate gear 44 rotates in the direction of arrow L in response to rotary drive of the input gear 43 (not illustrated). Thereafter, the tooth 44*a*1 of the first intermediate gear portion provided upstream of the circular arc portion 44*c* in the rotational direction L transmits the rotary drive to the leading tooth 41*a*1 provided upstream of the circular are concave portion 41*c* in the rotational direction R. Thus, the unsealing gear 41 starts rotating in the direction of arrow R. Accordingly, the second intermediate gear portion 44*b* and the second unsealing gear portion 41*b* are sequentially meshingly engaged with each other, as illustrated in FIGS. 10B and 10C. In this manner, the unsealing gear 41 rotates.

Figure 10D:
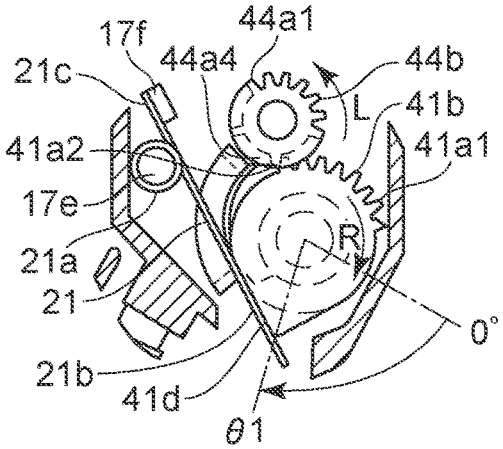
Figure 10B:
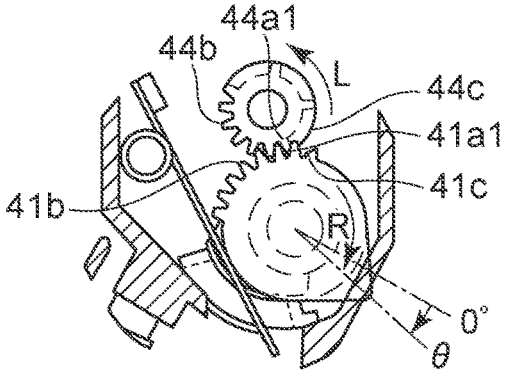

FIG. 10D illustrates the second intermediate gear portion 44*b* and the second unsealing gear portion 41*b* after meshing is completed. At this time, the sealing unit 20 is moved from the close position at which the sealing unit 20 is in a sealing state to the first open position by rotating an unsealing angle θ1 in the direction of arrow R illustrated in FIG. 10D. In this manner, the unsealing operation is completed.

At this time, a biasing spring 21 provided on the first frame 17 is brought into contact with a biased portion 41*d* of the unsealing gear 41. The biasing spring 21 is a torsion coil spring, and a winding portion 21*a* is engaged with a boss 17*e* provided on the side surface of the first frame 17. In addition, one arm portion 21*b* is in contact with the biased portion 41*d* of the unsealing gear 41, and the other arm portion 21*c* is in contact with a restriction rib 17*f* of the first frame 17. The biased portion 41*d* is formed so as to be parallel to the arm portion 21*b* at this time. In this manner, the biasing spring 21 does not apply, to the unsealing gear 41, a force to rotate the unsealing gear 41 from this phase in a direction opposite to the direction of arrow R. That is, once moved to the first open position, the sealing unit 20 does not return from the first open position to the close position again.

When the intermediate gear 44 further rotates in the direction of arrow L, the tooth 44*a*4 of the first intermediate gear portion transmits the driving power to the tooth 41*a*2 (hereinafter referred to as a "trailing tooth"). Note that the tooth 41*a*2 which is one of the teeth of the first unsealing gear portion 41*a* serves as the other contact portion. Accordingly, the unsealing gear 41 is further rotated in the direction of arrow R. At this time, the biasing spring 21 biases the unsealing gear 41 in such a direction that prevents the rotation of the biased portion 41*d* in the direction of arrow R. Subsequently, the unsealing gear 41 illustrated in FIG. 10D rotates in the direction of arrow R. After a short while, the transmission of the driving power from the intermediate gear 44 is stopped because the first intermediate gear portion 44*a* has a missing tooth.

Figure 10E:
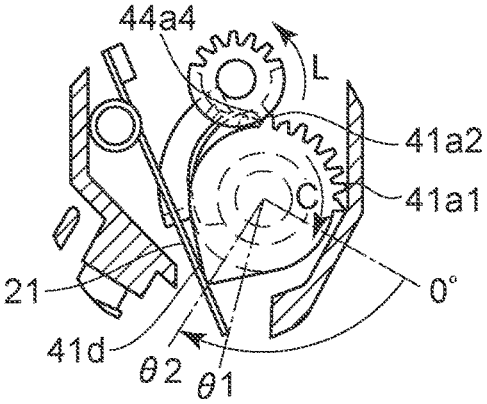
Figure 10C:
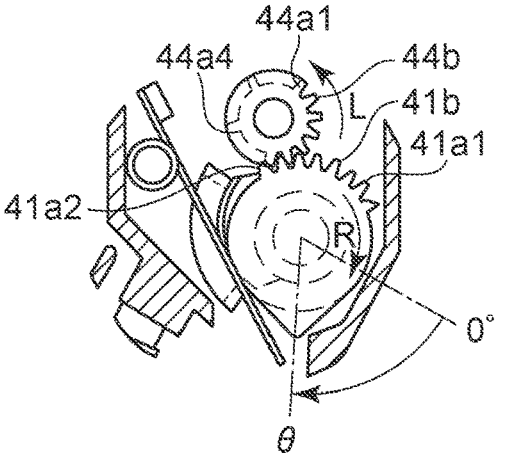

Subsequently, as illustrated in FIG. 10E, the unsealing gear 41 is rotated by the biasing spring 21 in the direction of arrow C and returns to the phase illustrated in FIG. 10D. The position (the second open position) of the sealing unit 20 at the moment when the drive transmission from the intermediate gear 44 is stopped is a position rotationally away from the close position (in a sealed state) in the direction of arrow R by the maximum open angle θ2.

That is, while the intermediate gear 44 is being separated from the unsealing gear 41, the biasing spring 21 moves the unsealing gear 41 in a direction opposite to the direction in which the unsealing gear 41 has been moved by the intermediate gear 44.

Figure 10F:
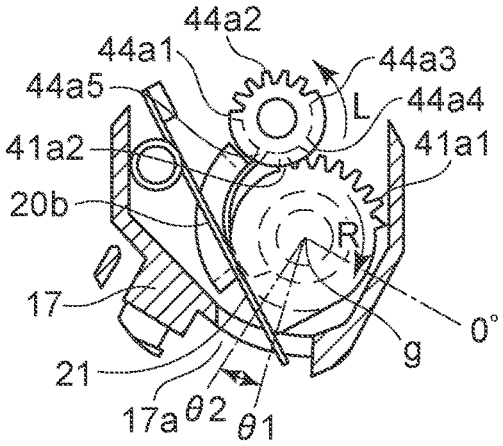

Thereafter, as illustrated in FIG. 10F, the intermediate gear 44 continues to rotate in the direction of arrow L. One tooth 44*a*5 upstream of the tooth 44*a*4 of the first intermediate gear portion in the rotational direction L is brought into contact with the trailing tooth 41*a*2. Thus, the unsealing gear 41 starts rotating in the direction of arrow R again. Since as described above, the first intermediate gear portion 44*a* serves as a pair of contact portions that are intermittently and repeatedly brought into contact with the trailing tooth 41*a*2, the sealing unit 20 repeatedly executes a reciprocating motion between the first open position and the second open position. As described above, the unsealing operation and the agitating operation can be achieved with a simple component configuration using a pair of partially toothed gears, which serves as a pair of contact portions, and a spring.

In addition, by employing the present drive configuration, the movement start acceleration in the direction in which the sealing unit 20 is returned from the second open position to the first open position by the biasing spring 21 is larger than the movement start acceleration when the sealing unit 20 is moved from the first open position to the second open position by the gears.

That is, the maximum value of acceleration when the sealing unit 20 is returned from the second open position to the first open position by the biasing spring 21 differs from the maximum value of acceleration when the sealing unit 20 is moved from the first open position to the second open position by the intermediate gear 44. More specifically, the maximum value of the acceleration when the sealing unit 20 is returned from the second open position to the first open position by the biasing spring 21 is larger than the maximum value of the acceleration when the sealing unit 20 is moved from the first open position to the second open position by the intermediate gear 44. Note that according to the present example embodiment, the acceleration has a maximum value when the movement in each of the directions is started.

By providing a difference in movement start acceleration between the forward movement and the return movement, the toner deposited on the sealing unit 20 can be shaken off. As a result, the amount of toner to be actually used in the developer containing chamber 26 can be increased.

Agitating Function of Sealing Unit

Figure 12A:
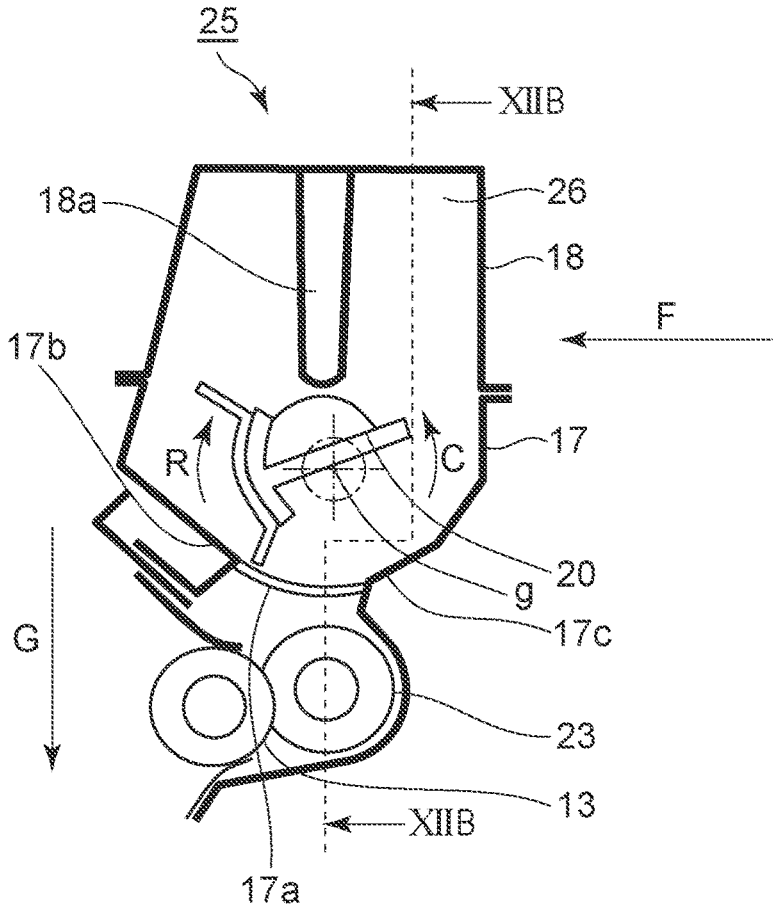
FIGS. 12A and 12B illustrate a sealing unit disposed at a first open position according to an embodiment of the present disclosure.
Figure 12B:
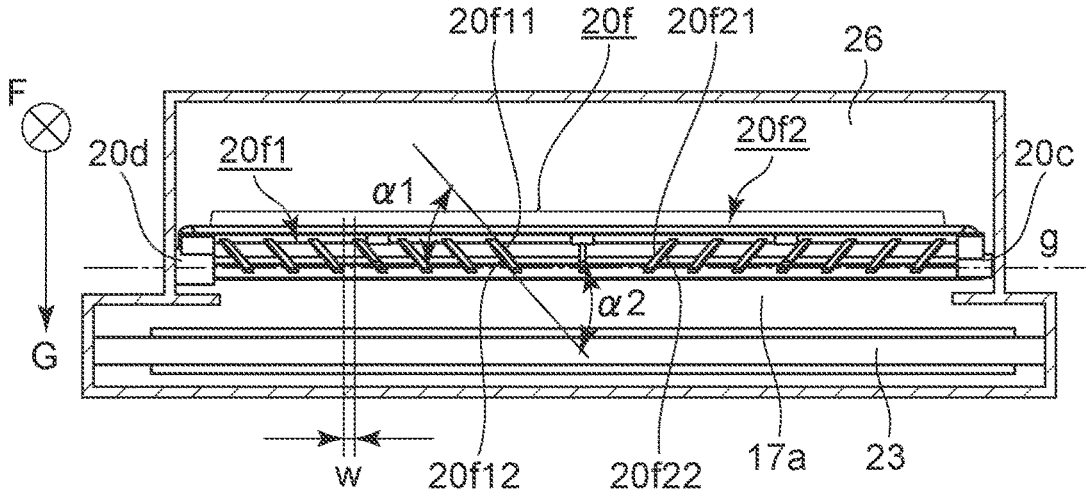
Figure 13A:
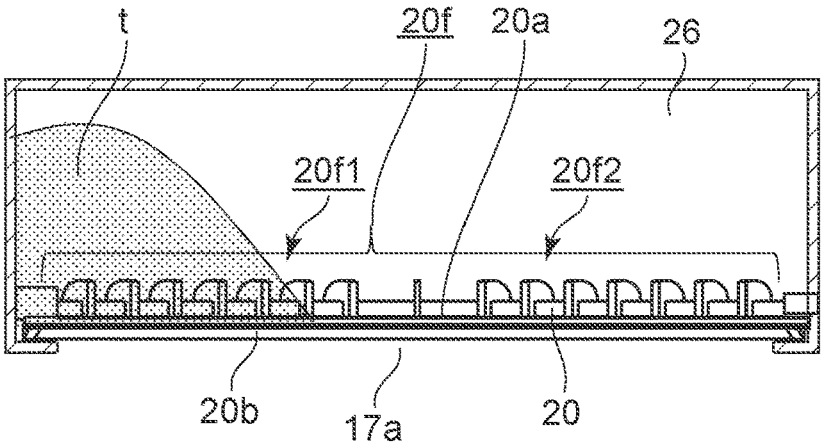
FIGS. 13A to 13C illustrate the movement of the sealing unit and a developer according to an embodiment of the present disclosure.
Figure 13B:
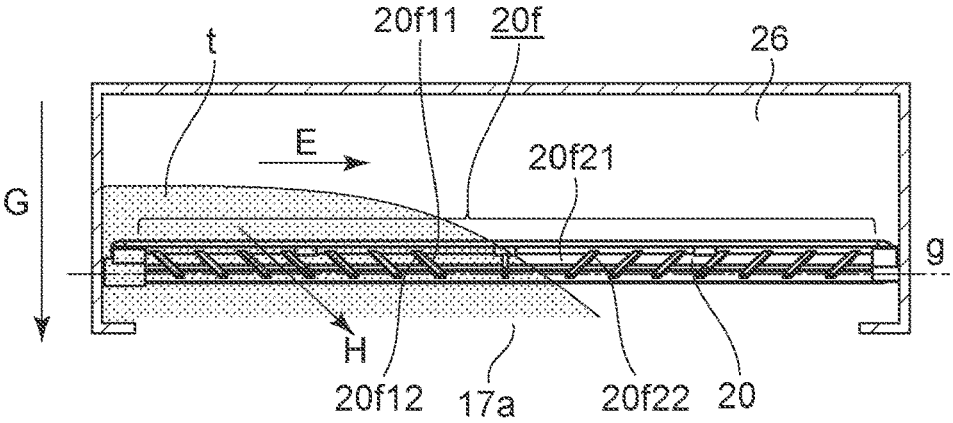
Figure 13C:
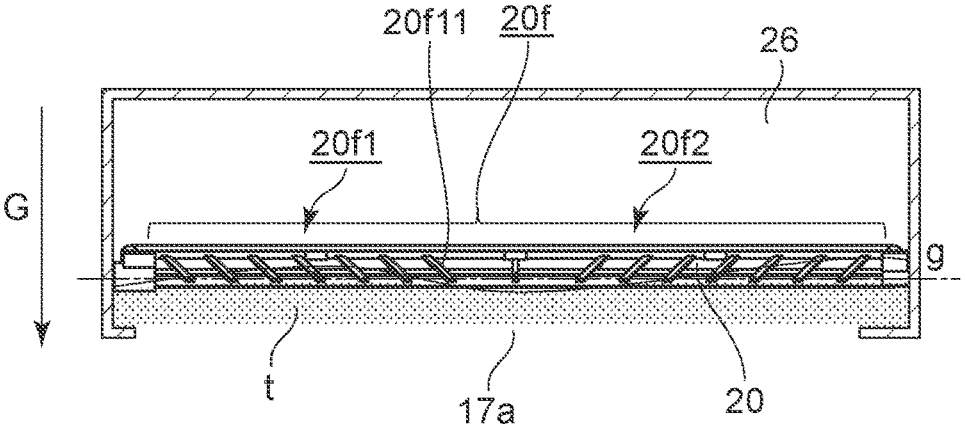
Figure 14A:
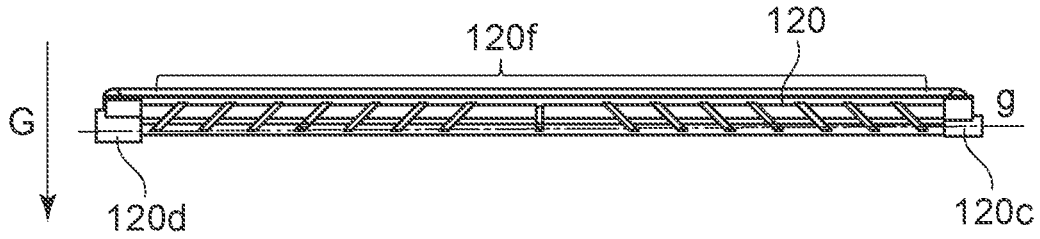
FIGS. 14A and 14B illustrate another form of the sealing unit according to an embodiment of the present disclosure.
Figure 14B:
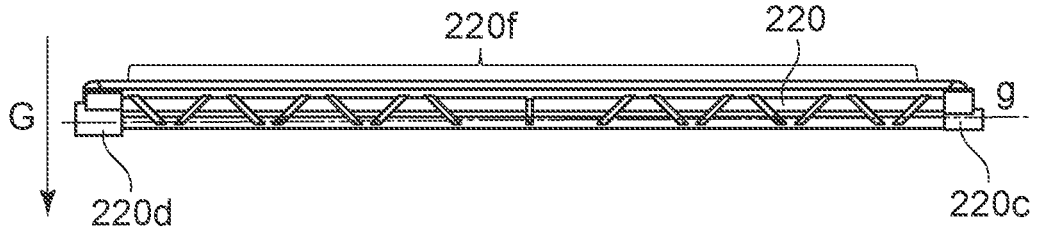

The agitating function of the sealing unit 20 is described below with reference to FIG. 1, FIGS. 5A and 5B, FIGS. 6A to 6E, FIGS. 12A and 12B, FIGS. 13A to 13C, and FIGS. 14A and 14B. FIGS. 12A and 12B illustrate the developer container unit 25 when the sealing unit 20 is located at the first open position. FIG. 12A is a cross-sectional view of the developer container unit 25 as viewed in the longitudinal direction. Arrow G in FIG. 12A denotes the gravitational force direction. Hereinafter, the direction of arrow G is referred to as a "gravitational force direction G". FIG. 12B is a cross-sectional view of the developer container unit 25 taken along a section line XIIB-XIIB of FIG. 12A. Note that for convenience of description, some parts are not illustrated. FIGS. 13A to 13C illustrate the movement of the toner when the sealing unit 20 executes a reciprocating motion. FIG. 13A illustrates the toner shifted to one side of the developer containing chamber 26 in the longitudinal direction. FIG. 13B illustrates how the toner moves as the sealing unit 20 executes a reciprocating motion. FIG. 13C illustrates the toner after being put back in place by the reciprocating motion executed by the sealing unit 20.

As used herein, the direction in which the sealing unit 20 rotates from the second open position toward the first open position is referred to as a "first direction". The direction in which the sealing unit 20 rotates from the first open position toward the second open position is referred to as a "second direction". That is, the second direction is opposite to the first direction.

When the developer container unit 25 is transported, the toner may be shifted to one side of the developer containing chamber 26. If the developer container unit 25 is used with the toner shifted to one side, the output image may be locally faded and, therefore, the shift of the toner to one side needs to be eliminated.

As illustrated in FIG. 5A, the shaft member 20*a* includes the feeding blades 20*f* including the ribs 20*f*1 (a first feeding portion) and the ribs 20*f*2 (a second feeding portion). The feeding blades 20*f* protrude from the shaft member 20*a* in a direction orthogonal to the direction of the rotational axis g. As viewed in the direction of the rotational axis g, the feeding blades 20*f* are located across the rotational axis g from the sealing portion 20*b*. In addition, the ribs 20*f*1 and the ribs 20*f*2 are provided at a plurality of positions in the longitudinal direction (the direction of the rotational axis g). According to the present example embodiment, the ribs 20*f*1 and the ribs 20*f*2 are integrally formed with the shaft member 20*a*. Furthermore, the feeding blades 20*f* are provided so as to be inclined with respect to the direction of the rotational axis g.

As illustrated in FIG. 12B, the ribs 20*f*1 are disposed between a center portion of the shaft member 20*a* and one end of the shaft member 20*a* in the longitudinal direction. The ribs 20*f*2 are disposed between the center portion of the shaft member 20*a* and the other end of the shaft member 20*a* in the longitudinal direction. In addition, the shaft portion 20*d* is disposed at one end portion of the shaft member 20*a*. The shaft portion 20*c* is disposed at the other end of the shaft member 20*a*.

Each of the ribs 20*f*1 has a first inner side surface 20*f*11 facing toward the center portion of the shaft member 20*a* in the longitudinal direction. In addition, the rib 20*f*1 has a first outer side surface 20*f*12 facing toward the one end of the shaft member 20*a* in the longitudinal direction. The rib 20*f*1 is inclined with respect to the direction of the rotational axis g. The rib 20*f*1 is also inclined with respect to the direction orthogonal to the rotational axis g. The rib 20*f*1 is inclined in the first direction with respect to the direction of the rotational axis g.

As illustrated in FIG. 12B, when the sealing unit 20 is located at the first open position, the first inner side surface 20*f*11 is an upper surface of the rib 20*f*1 in the gravitational force direction G. The first outer side surface 20*f*12 is a lower surface of the rib 20*f*1 in the gravitational force direction G. At this time, as viewed in a direction F orthogonal to the gravitational force direction G and the rotational axis g, the first inner side surface 20*f*11 is inclined at an inclination angle $\alpha 1$ with respect to the direction of the rotational axis g, and the first outer side surface 20*f*12 is inclined at an inclination angle $\alpha 2$ with respect to the rotational axis g. According to the present example embodiment, each of the inclination angle $\alpha 1$ and inclination angle $\alpha 2$ is 45 degrees.

That is, the first inner surface 20*f*11 is a surface facing inward in the longitudinal direction. The first outer side surface 20*f*12 is a surface facing outward in the longitudinal direction.

When the sealing unit 20 (the shaft member 20*a*) rotates in the first direction (the direction of arrow C), the first inner side surface 20*f*11 feeds the toner toward the center portion of the shaft member 20*a* in the longitudinal direction. That is, when the sealing unit 20 (the shaft member 20*a*) rotates in the first direction (the direction of arrow C), the first inner side surface 20*f*11 feeds the toner inward in the longitudinal direction. At this time, the first inner surface 20*f*11 feeds the toner so as to lift the toner. As a result, a gap is formed under the lifted toner, and the toner is loosened and, thus, the flowability of the toner is increased.

In contrast, when the sealing unit 20 (the shaft member 20*a*) rotates in the second direction (the direction of arrow R), the first outer surface 20*f*12 feeds the toner toward one end portion of the shaft member 20*a* in the longitudinal direction. That is, when the sealing unit 20 (the shaft member 20*a*) rotates in the second direction (the direction of arrow R), the first outer side surface 20*f*12 feeds the toner outward in the longitudinal direction. At this time, the first outer side surface 20*f*11 feeds the toner so as to push down the toner.

Furthermore, the inclination direction of the feeding blades 20*f* on one side of the center portion of the developer containing chamber 26 in the longitudinal direction differs from that on the other side. That is, the ribs 20*f*2 are disposed across the center portion of the developer containing chamber 26 from the ribs 20*f*1. According to the present example embodiment, the rib 20*f*1 and the rib 20*f*2 have a symmetrical shape (are mirror images) with respect to a plane that passes through the middle point of the sealing unit 20 in the longitudinal direction and that is orthogonal to the rotational axis g.

The rib 20*f*2 has a second inner side surface 20*f*21 facing toward the center portion of the shaft member 20*a* in the longitudinal direction. The rib 20*f*2 has a second outer side surface 20*f*22 facing toward the other end portion of the shaft member 20*a* in the longitudinal direction. The rib 20*f*2 is inclined with respect to the direction of the rotational axis g. In addition, the rib 20*f*2 is inclined with respect to the plane orthogonal to the rotational axis g. The rib 20*f*2 is inclined in the second direction with respect to the direction of the rotational axis g.

As illustrated in FIG. 12B, when the sealing unit 20 is disposed at the first open position, the second inner side surface 20*f*21 is an upper surface of the rib 20*f*2 in the gravitational force direction G. The second outer side surface 20*f*22 is a lower surface of the rib 20*f*2 in the gravitational force direction G. At this time, as viewed from a direction F that is orthogonal to the gravitational force direction G and the rotational axis g, the rib 20*f*2 is inclined in the direction opposite to the direction in which the rib 20*f*1 is inclined.

That is, the second inner surface 20*f*21 is a surface facing inward in the longitudinal direction. The second outer side surface 20*f*22 is a surface facing outward in the longitudinal direction.

When the sealing unit 20 (the shaft member 20*a*) rotates in the first direction (the direction of arrow C), the second inner side surface 20*f*21 feeds the toner toward the center portion of the shaft member 20*a* in the longitudinal direction. That is, when the sealing unit 20 (the shaft member 20*a*) rotates in the first direction (the direction of the arrow C), the second inner side surface 201*f*21 feeds the toner inward in the longitudinal direction. At this time, the second inner side surface 20*f*21 feeds the toner so as to lift the toner. As a result, a gap is formed under the lifted toner, and the toner is loosened. In this manner, the flowability of the toner is increased.

In contrast, when the sealing unit 20 (the shaft member 20*a*) rotates in the second direction (the direction of arrow R), the second outer side surface 20*f*22 feeds the toner toward the other end of the shaft member 20*a* in the longitudinal direction. That is, when the sealing unit 20 (shaft member 20*a*) rotates in the second direction (the direction of the arrow R), the second outer side surface 20*f*22 feeds the toner outward in the longitudinal direction. At this time, the second outer side surface 20*f*22 feeds the toner so as to push down the toner.

In addition, when the sealing unit 20 is located at the first open position, the sealing unit 20 inclines such that the feeding blades 20*f* incline from the upstream to the downstream of the gravitational force direction G. Furthermore, as in the case where the sealing unit 20 is located at the first open position, even when the sealing unit 20 is located at the second open position (FIG. 6E), the sealing unit 20 inclines such that the feeding blades 20*f* incline from the upstream to the downstream of the gravitational force direction G.

Furthermore, a gap (a spacing w) is formed between the adjacent ribs 20*f*1 in the longitudinal direction such that the ribs 20*f*1 do not overlap each other. Note that a gap of the same size is also formed between the adjacent ribs 20*f*2.

Note that only some of the plurality of feeding blades 20*f* need to be inclined. However, according to the present example embodiment, all of the feeding blades 20*f* are inclined.

The movement of the toner in accordance with the agitating operation performed by the sealing unit 20 is described below.

As illustrated in FIG. 1, in the developer container unit 25, the developer containing chamber 26 that contains toner is disposed above the developing roller 13 and the developer supply roller 23 in the gravitational force direction G. In addition, the sealing unit 20 is disposed above the opening 17*a* in the gravitational force direction G inside the developer containing chamber 26. When the sealing unit 20 is disposed at the close position, the sealing portion 20*b* is disposed below the feeding blades 20*f* in the gravitational force direction G. Thus, the sealing portion 20*b* seals the opening 17*a*. Subsequently, the sealing unit 20 is moved from the close position to the first open position through rotation of the unsealing angle θ1 in the direction of arrow R and, thus, the opening 17*a* is unsealed (refer to FIG. 6D). If the sealing unit 20 is located between the first open position and the second open position, the gap d is formed between the sealing unit 20 and the bottom surface of the first frame 17 (refer to FIG. 6D). Accordingly, the toner moves to the opening 17*a* through the gap d. In addition, since the spacing w is provided between the adjacent ribs 20*f*1 and between the adjacent ribs 20*f*2, the toner moves to the opening 17*a* through the spacing w. The sealing portion 20*b* is located on the opposite side of the opening 17*a* from the feeding blades 20*f*. As a result, when the sealing unit 20 executes a reciprocating motion, the sealing portion 20*b* and the feeding blades 20*f* alternately feed the developer toward the opening 17*a*.

Suppose that as illustrated in FIG. 13A, the developer is shifted to one side of the developer containing chamber 26 in the longitudinal direction. This situation possibly occurs when the developer container unit 25 is transported, for example.

Since as described above, the sealing unit 20 executes a reciprocating motion between the first open position and the second open position, the ribs 20*f*1 vibrate the toner to loosen the toner. As a result, the accumulated toner starts being spread out and moves to the downstream in the gravitational force direction G. Thereafter, as illustrated in FIG. 13B, part of the toner drops into the opening 17*a* through the spacing w.

When the sealing unit 20 rotates in the first direction, some amount of toner moves in the direction of arrow H along the first inner side surfaces 20*f*11 of the feeding blades 20*f*. When the sealing unit 20 rotates in the second direction, some amount of toner is fed outward in the longitudinal direction by the first outer side surfaces 20*f*12. In contrast, in the direction orthogonal to the rotational axis g, the top end of each of the feeding blades 20*f* is disposed at a position away from the frame 17. Consequently, a gap is formed between the feeding blade 20*f* and the frame 17. In an area that the ribs 20*f*1 do not reach, the toner is not returned outward in the longitudinal direction, and the space below the sealing unit 20 is filled with the toner.

By repeating the operation, the toner moves from one end in the longitudinal direction of the developer containing chamber 26 to the middle point (arrow E). That is, the space under the sealing unit 20 is filled with toner from the one end in the longitudinal direction toward the middle point. Some of the toner moved beyond the middle point in the longitudinal direction is returned to the middle point by the second inner surfaces 20*f*21 of the ribs 20*f*2. In contrast, the toner in the area that the ribs 20*f*2 do not reach is not returned to the middle point. Since the ribs 20*f*1 continue to feed the toner toward the other end in the longitudinal direction, the toner is accumulated in the space below the sealing unit 20 even in the area where the ribs 20*f*2 are located. In addition, some of the toner is fed toward the other end in the longitudinal direction by the second outer side surfaces 20*f*22.

Finally, as illustrated in FIG. 13C, the toner shifted to one side in the longitudinal direction in the developer containing chamber 26 can be spread over the entire area in the longitudinal direction. That is, the reciprocating motion executed by the sealing unit 20 can prevent the toner from shifting to one side of the developer material containing chamber 26 in the direction of the rotational axis g (the axial direction) of the sealing unit 20 (the shaft member 20*a*).

In addition, according to the above-described drive configuration, the movement start acceleration in the direction in which the sealing unit 20 moves from the second open position to the first open position (the first direction) is larger than the movement start acceleration in the direction in which the sealing unit 20 moves from the first open position to the second open position (the second direction). That is, the maximum value of the acceleration of the sealing unit 20 in the direction in which the sealing unit 20 moves from the second open position to the first open position (the first direction) is larger than the maximum value of the acceleration in the direction in which the sealing unit 20 moves from the first open position to the second open position (the second direction). Consequently, the operation to move from the second open position to the first open position can lift toner particles deposited on the first inner side surfaces 20*f*11 of the feeding blades 20*f* in the air so as to move the toner from the one end to the middle point in the longitudinal direction more rapidly.

If the toner is shifted to the other end of the developer containing chamber 26, the toner moves in a direction opposite to the above-described direction. Description of the case is not provided here.

The reciprocating motion described above is continuously executed by the sealing unit 20 even during the image forming operation for forming an image on a recording material.

Note that to feed the toner in the longitudinal direction and distribute the toner over the entire area uniformly in the longitudinal direction, it is required to set the feeding blades 20*f* in consideration of the influence of the first outer side surfaces 20*f*12 of the feeding blades 20*f* and the influence of the shape of the lower portion of the feeding blade 20*f* below the rotational axis g in the gravitational force direction G. For example, as illustrated in FIGS. 6D, 6E and 13C, the setting is made such that as viewed in the longitudinal direction, the shape of the lower portion of the feeding blade

20*f* below the rotational axis g in the gravitational force direction G is smaller than the shape of the upper portion of the feeding blade 20*f* above the rotational axis g. That is, during the reciprocating motion executed by the sealing unit 20, the sealing unit 20 moves so that the portions of the rib 20*f*1 and the rib 20*f*2 located above the horizontal plane passing through the rotational axis g are larger than the portions thereof located below the horizontal plane, respectively. As a result, if the height of the toner is lower than the rotational axis g, the feeding blades 20*f* are less likely to be in contact with the toner located between the opening 17*a* and the sealing unit 20. Thus, the toner located below the rotational axis g can be prevented from moving in the longitudinal direction. That is, the amount of toner can be reduced that moves in the direction opposite to the toner feeding direction while the shifted toner is being evenly distributed.

Note that to break up the aggregated toner particles at one side in the longitudinal direction by the sealing unit 20 reciprocating around the rotational axis g and feed the toner particles, the inclination angle $\alpha$1 and the inclination angle $\alpha$2 can be set to predetermined angles as appropriate. For example, the inclination angle $\alpha$1 and the inclination angle $\alpha$ can be set to different angles.

In addition, the shape of the feeding blade 20*f* is not limited to the above-described shape. For example, a feeding blade 120*f* of a sealing unit 120 illustrated in FIG. 14A or a feeding blade 220*f* of a sealing unit 220 illustrated in FIG. 14B can be used. Even such shapes enable the aggregated toner particles to be fed from one side to the center portion in the longitudinal direction by providing a plurality of inclined portions that are inclined downward in the gravitational force direction G with respect to the rotational axis g. However, the above-described feeding blades 20*f* of the sealing unit 20 can more effectively eliminate the toner shifting to one side.

Alternatively, the feeding blades 20*f* may be configured such that some of the feeding blades 20*f* function as the to-be-pressed portion 20*e* described above (refer to FIG. 6B).

As described above, the sealing unit 20 executes a reciprocating motion around the rotational axis g between the first open position and the second open position. In addition, the sealing unit 20 includes a plurality of the feeding blades 20*f* inclined with respect to the rotational axis g and the gravitational force direction G. As a result, toner shifted to one side of the developer containing chamber 26 in the longitudinal direction and aggregated in the developer containing chamber 26 can be efficiently broken up and, thus, the toner shifting inside the developer containing chamber 26 can be efficiently eliminated. Therefore, by using the sealing unit 20 according to the present example embodiment, the toner can be uniformly supplied over the entire areas of the developing roller 13 and the developer supply roller 23 in the longitudinal direction. Consequently, the occurrence of a locally faded output image can be prevented. Alternatively, the waiting time can be reduced which is required until the toner is uniformly supplied over the entire areas of the developing roller 13 and the developer supply roller 23 in the longitudinal direction.

Furthermore, if the sealing unit 20 using the above-described sealing portion 20*b* that is compressed continues to rotate in one direction, an operation to close the opening 17*a* and an operation to compress the sealing portion 20*b* are repeatedly performed. In addition, the pressing portion 18*a* and the sealing unit 20 may interfere with each other. In this case, the rotational load of the sealing unit 20 is increased. In addition, an operation to discharge the toner through the opening 17*a* may be interfered. In contrast, according to the configuration described above, the above-described problems can be solved by reciprocating the sealing unit 20.

Note that the shaft member 20*a* according to the present example embodiment can be used as a feeding member even without the sealing portion 20*b*.

Second Example Embodiment

Agitating Portion

A second example embodiment of the present disclosure is described below with reference to FIGS. 15, 16, 17A to 17C, and 18A to 18C. Description of the configuration and operation that are the same as those of the first example embodiment is not repeated.

Unlike the first example embodiment, a sealing unit 20 according to the second example embodiment further includes an agitating portion.

Figure 15:
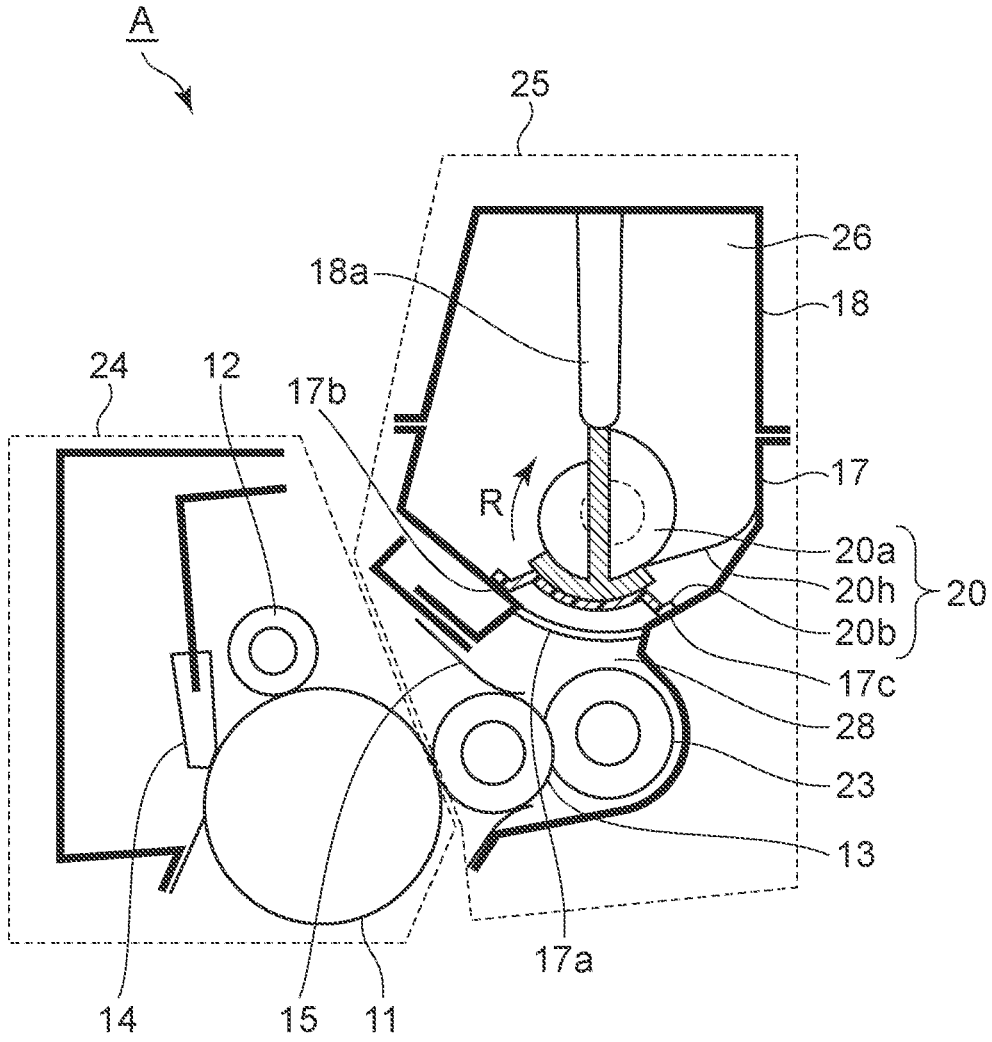
FIG. 15 is a main cross-sectional view of a process cartridge including a developer container unit according to another embodiment of the present disclosure.
Figure 16:
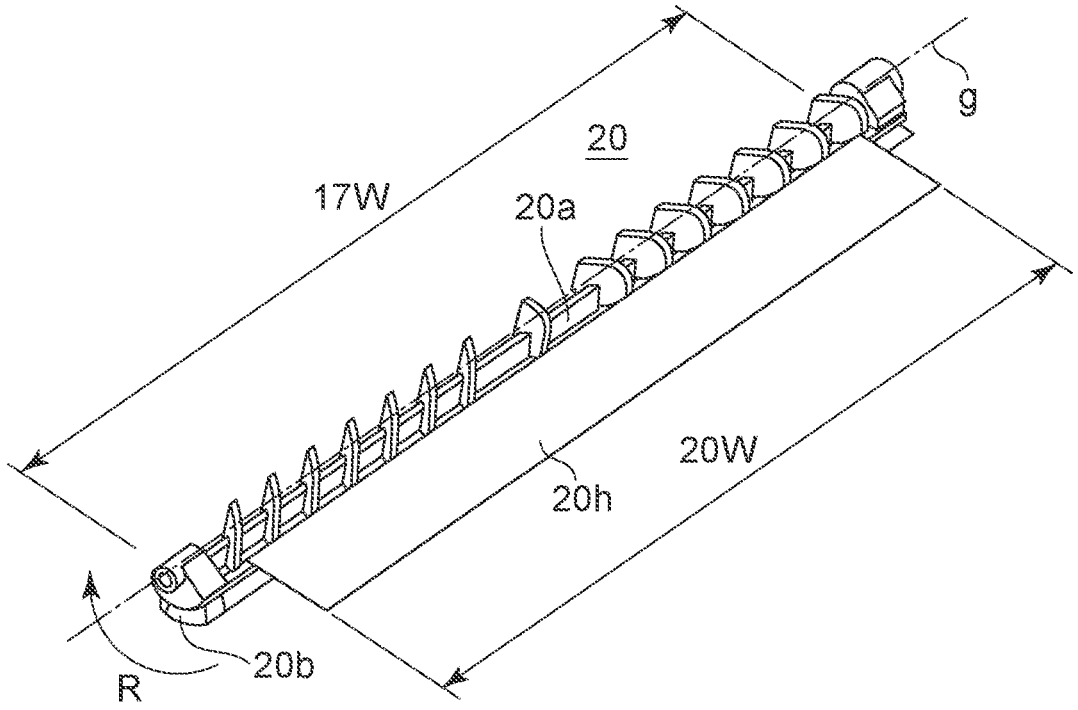
FIG. 16 is a perspective view illustrating the configuration of an agitating portion according to another embodiment of the present disclosure.
Figure 17A:
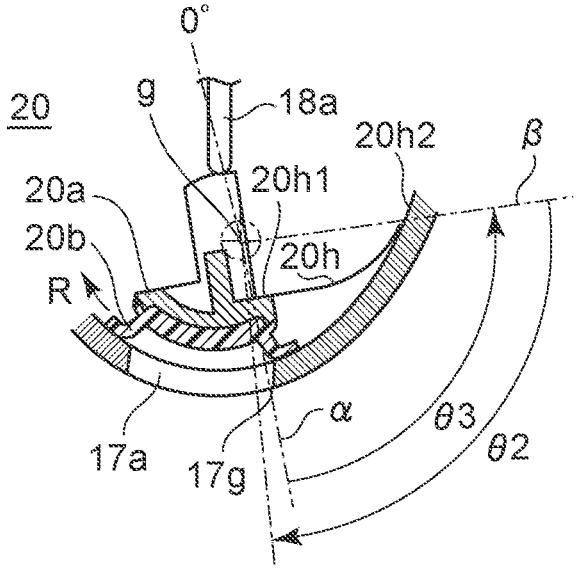
FIGS. 17A to 17C illustrate the configuration and operation of an agitating portion according to another embodiment of the present disclosure.
Figure 17B:
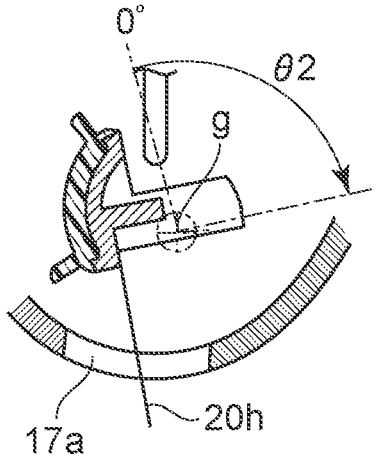
Figure 17C:
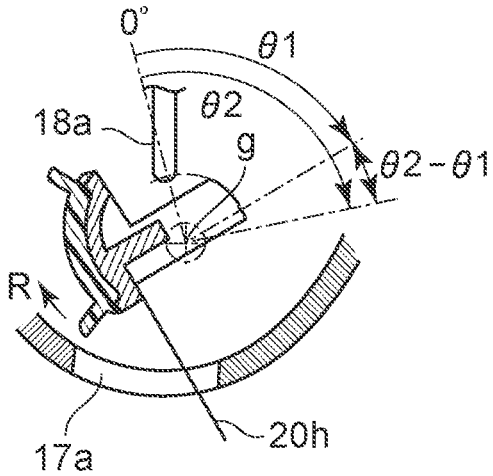
Figure 18A:
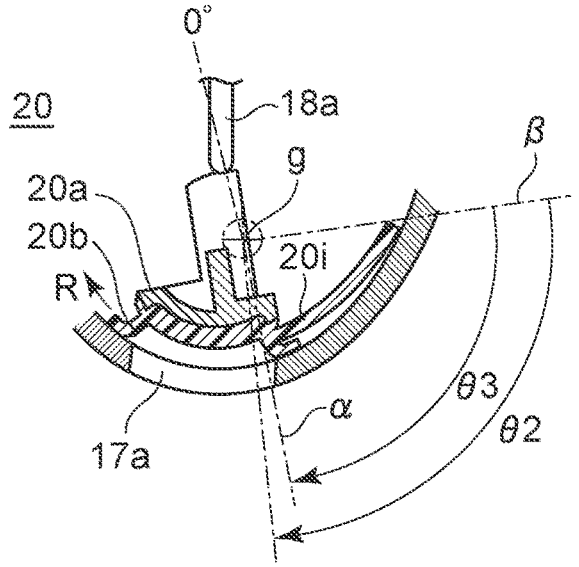
FIGS. 18A to 18C illustrate the configuration and operation of another form of an agitating portion according to another embodiment of the present disclosure.
Figure 18B:
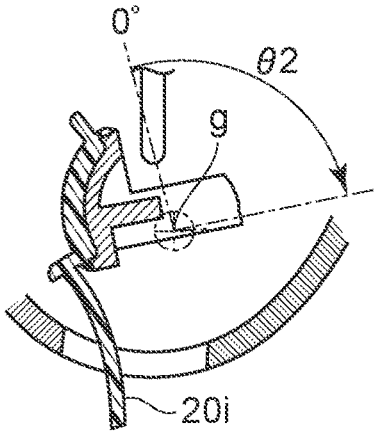
Figure 18C:
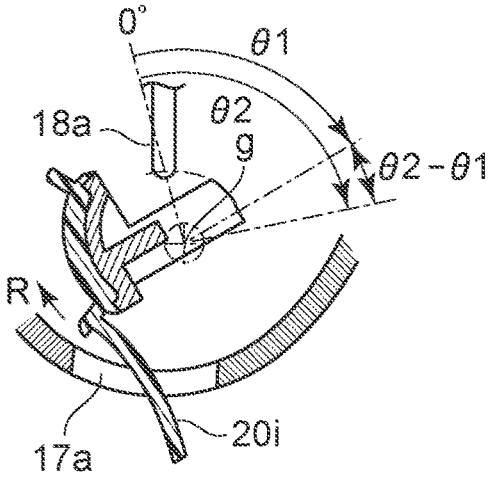

FIG. 15 is a main cross-sectional view of a process cartridge including a developer container unit according to the example embodiment of the present disclosure. FIG. 16 is a perspective view illustrating the configuration of an agitating portion 20*h* according to the example embodiment of the present disclosure. FIGS. 17A to 17C illustrate the configuration and operation of the agitating portion 20*h* according to the example embodiment of the present disclosure. FIGS. 18A to 18C illustrate the configuration and operation of an agitating portion 20*i* having another shape according to another example embodiment of the present disclosure.

The agitating portion 20*h* and the related configuration are described below with reference to FIGS. 15, 16, and 17A to 17C.

As illustrated in FIG. 15, the developer container unit 25 has a developing chamber 28 disposed therein below the opening 17*a* in the gravitational force direction. The developing chamber 28 supplies, to the developing roller 13, the toner discharged through the opening 17*a*.

Furthermore, as illustrated in FIG. 15, the sealing unit 20 further includes an agitating portion 20*h*. The agitating portion 20*h* is disposed upstream of the sealing portion 20*b* in the unsealing direction R of the shaft member 20*a* (the direction in which the sealing unit 20 moves from the closing position to the first open position). When the sealing unit 20 is located at the close position, the agitating portion 20*h* is located upstream of the opening 17*a* in the unsealing direction R.

The agitating portion 20*h* is a polyethylene terephthalate sheet having a thickness of 50 μm. Alternatively, the agitating portion 20*h* may be made of polyphenylene sulfide or polypropylene. Note that the thickness is not limited to the above-mentioned value.

The structure of the agitating portion 20*h* extending in the transverse direction is described below. As illustrated in FIG. 17A, one end portion 20*h*1 of the agitating portion 20*h* is fixed to the shaft member 20*a* by a double-sided tape (not illustrated) at a position downstream of the agitating portion 20*h* in the unsealing direction R. The other end of the agitating portion 20*h* is a free end 20*h*2.

The length of the agitating portion 20*h* in the transverse direction is described below with reference to FIGS. 17A to 17C. Let $\alpha$ be a straight line extending along a plane orthogonal to the rotational axis g between the pivot center g of the sealing unit 20 and an upstream end portion 17*g* of the opening 17*a* in the unsealing direction R when the sealing unit 20 is located at the close position illustrated in FIG. 17A. In addition, let β be a straight line extending between the pivot center g of the sealing unit 20 and the free end 20*h*2 of the agitating portion 20*h*. Furthermore, let θ3 be an angle formed by the straight line α and the straight line β. Then, the length in the transverse direction of the agitating portion 20*h* is set such that the angle θ3 is smaller than a maximum angle θ2 through which the sealing unit 20 moves from the close position to the second open position.

Subsequently, in the longitudinal direction, as illustrated in FIG. 16, a length 20W of the agitating portion 20*h* is shorter than a length 17W (refer to FIG. 4) of the opening 17*a*. This is because the agitating portion 20*h* enters the opening 17*a* and further enters the developing chamber 28 during the reciprocation motion executed after the unsealing operation performed by the sealing unit 20. At this time, the length 17W of the opening 17*a* and the length 20W of the agitating portion 20*h* are determined in consideration of the dimensional tolerances of related parts so that a gap is formed in the longitudinal direction between the opening 17*a* and the agitating portion 20*h*.

Note that the shape of the free end portion of the agitating portion 20*h* in the longitudinal direction is not limited to a straight line. The shape may be a concavo-convex shape or a shape having a free length that changes in the longitudinal direction, such as a shape having a notch in the longitudinal direction.

Operation and Effect of Agitating Portion

The operation performed by the agitating portion 20*h* is described below with reference to FIGS. 17A to 17C. The sealing unit 20 moves from the close position (refer to FIG. 17A) at which the toner is sealed in the developer container unit by the sealing unit 20 to the second open position through the maximum angle θ2 after unsealing (FIG. 17B) first. When the sealing unit 20 moves to the second open position, the free end 20*h*2 of the agitating portion 20*h* passes by the upstream end portion 17*g* of the opening 17*a* in the unsealing direction R. The agitating portion 20*h* passes through the opening 17*a* and enters the developing chamber 28. Thereafter, the sealing unit 20 reciprocates (oscillates) between the first open position illustrated in FIG. 17C and the second open position illustrated in FIG. 17B (θ2−θ1). In accordance with the reciprocating motion of the sealing unit 20, the agitating portion 20*h* enters the opening 17*a* and reciprocates inside the developing chamber 28.

As described above, the free end portion of the agitating portion 20*h* enters the developing chamber 28 after the unsealing operation of the sealing unit 20 and further mixes the toner inside the developing chamber 28 as the sealing unit 20 reciprocates. As a result, the toner in the developing chamber 28 is stably supplied to the developing roller 13, which leads to a stable image quality.

Structure of Agitating Portion of Another Example Embodiment

As the structure of an agitating portion 20*h* according to another example embodiment, the agitating portion 20*i* is described below with reference to FIGS. 18A to 18C. As illustrated in FIGS. 18A to 18C, the agitating portion 20*i* is integrally formed with the sealing portion 20*b* having elasticity. More specifically, by forming the sealing portion 20*b* described in the first example embodiment by using an elastomer, the sealing unit 20 is integrally formed with the sealing portion 20*b* by using an elastomer. Note that in this example, the thickness of the agitating portion 20*i* is set to 1 mm. However, the thickness can be changed as appropriate. By forming the agitating portion 20*i* integrally with the sealing portion 20*b* having elasticity, the assembly cost can be reduced.

Third Example Embodiment

A third example embodiment of the present disclosure is described below with reference to FIGS. 19A to 19C, and 20. Description of the structure and operation that are the same as those of the first example embodiment is not repeated.

According to the present example embodiment, the shape of the structure in the vicinity of the opening 17*a* differs from that of the first example embodiment.

Detailed Configuration of Example Sealing Unit

FIGS. 19A to 19C and FIGS. 20A to 20E are cross-sectional views illustrating the configuration and operation of a sealing unit 20 according to another example embodiment of the present disclosure.

Figure 19A:
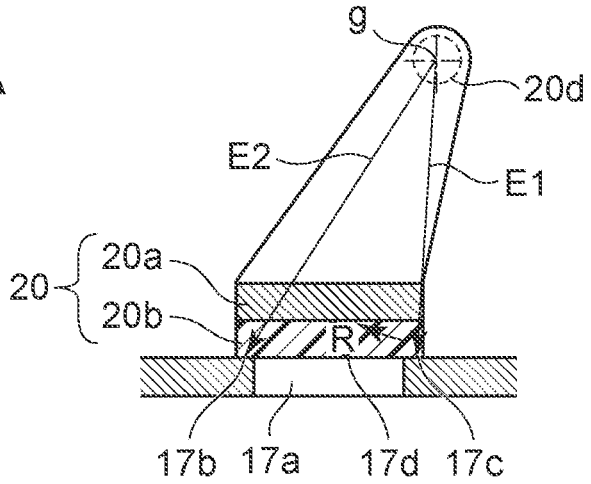
FIGS. 19A to 19C illustrate the operation performed by a sealing member according to another embodiment of the present disclosure.
Figure 19B:
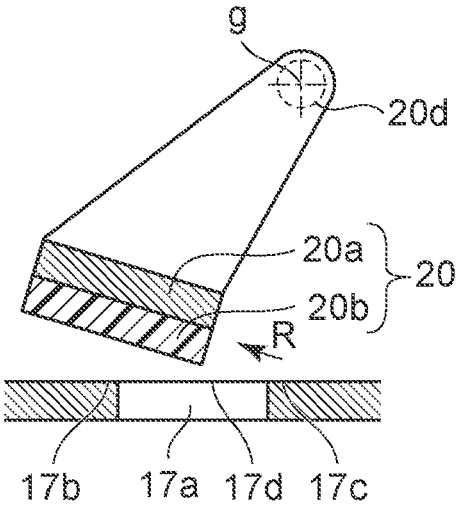
Figure 19C:
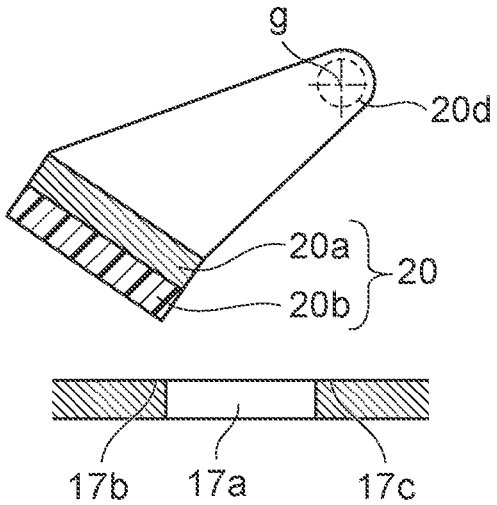

In FIGS. 19A to 19C, to-be-contacted portions 17*b*, 17*c*, and 17*d* around the opening 17*a* have flat surfaces. The unsealing operation proceeds from a sealing state illustrated in FIG. 19A to a sealing state illustrated in FIG. 19C via a sealing state illustrated in FIG. 19B. In this case, the pivot center (the rotational axis) g of the sealing unit 20 is disposed at a position closer to the to-be-contacted portion 17*c* than to the to-be-contacted portion 17*b*. That is, let E1 be the distance between the to-be-contacted portion 17*c* and the rotational axis g, and let E2 be the distance between the to-be-contacted portion 17*b* and the rotational axis g. Then, the rotational axis g is located at a position that satisfies the following condition: E1<E2.

As described above, the rotational axis g is disposed to be close to the to-be-contacted portion 17*c* located on the upstream side in the movement direction R at the start of the unsealing operation performed by the sealing portion 20*b*. As a result, as the unsealing operation progresses from the sealed state to the open state, the sealing portion 20*b* gradually moves away from the to-be-contacted portions 17*b*, 17*c*, and 17*d* (in the vertical direction in FIGS. 19A to 19C).

FIGS. 20A to 20E illustrate an example in which the to-be-contacted portions 17*b*, 17*c* and 17*d* have non-flat surfaces.

Figure 20A:
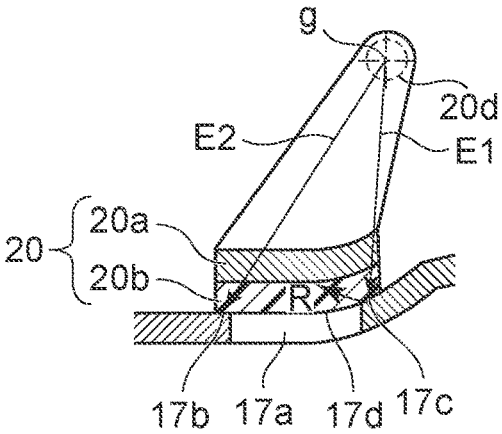
FIGS. 20A to 20E illustrate the operation performed by a sealing member according to another embodiment of the present disclosure.
Figure 20C:
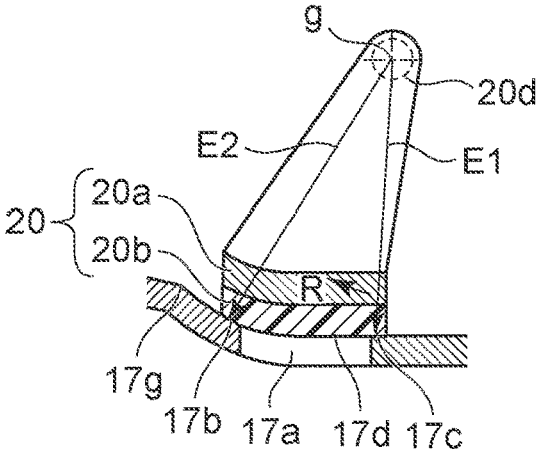
Figure 20B:
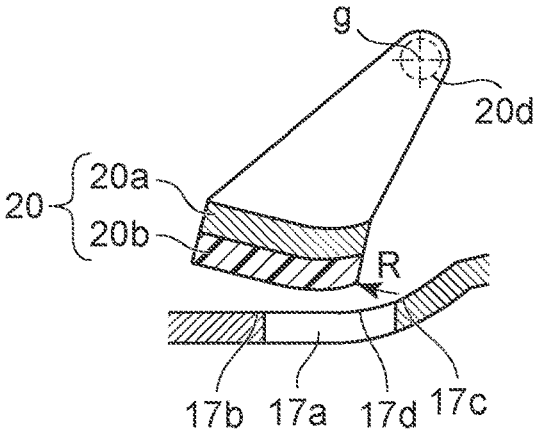

As illustrated in FIGS. 20A and 20B, the to-be-contacted portion 17*b* has a flat surface, and the to-be-contacted portion 17*c* has a curved surface. In FIG. 20A, the opening 17*a* is sealed. In FIG. 20B, the unsealing operation progresses. As illustrated in FIGS. 20A to 20B, even when the to-be-contacted portions 17*b*, 17*c*, and 17*d* are formed by a flat surface and a circular arc surface, it is only required that the rotational axis g of the sealing unit 20 be located at a position at which the sealing portion 20*b* gradually moves away from the to-be-contacted portions 17*b*, 17*c*, and 17*d* (at a position that satisfies the condition: E1<E2).

Figure 20D:
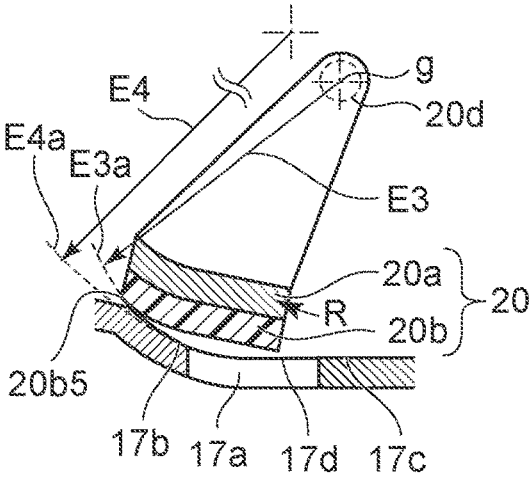

In FIGS. 20C and 20D, the to-be-contacted portion 17*b* has a curved surface, and the to-be-contacted portion 17*c* has a flat surface. In FIG. 20C, the opening 17*a* is sealed. In FIG. 20D, the unsealing operation progresses. As illustrated in FIGS. 20C and 20D, even when the to-be-contacted portions 17*b*, 17*c*, and 17*d* are formed by a flat surface and a circular are surface, it is only required that the rotational axis g of the sealing unit 20 be located at a position at which the sealing portion 20*b* gradually moves away from the to-be-contacted portions 17*b*, 17*c*, and 17*d* (at a position that satisfies the condition: E1<E2). In addition, a downstream side wall 17*g* of the to-be-contacted portion 17*b* in the movement direction R of the sealing portion 20*b* has a circular arc shape. This portion is referred to as a "circular arc E4*a*". The radius of the circular arc E4*a* is E4. A trajectory drawn by a downstream end 20*b*5 of the sealing portion 20*b* in the movement direction R of the sealing portion 20*b* is referred to as a "circular are E3*a*". The radius of the circular arc E3*a* is E3. At this time, it is desirable that the rotational axis g and the wall 17*g* be disposed such that E4 is larger than E3.

Figure 20E:
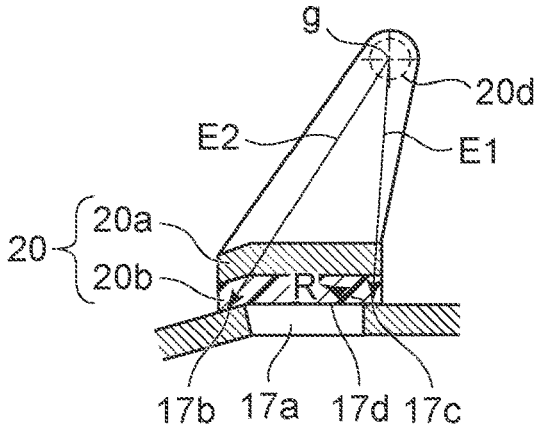

In addition, as illustrated in FIG. 20E, the to-be-contacted portions 17*b*, 17*c* and 17*d* may have a combination of a plurality of flat surfaces or a combination of a plurality of curved surfaces (not illustrated). Even in this case, it is only required that the rotational axis g of the sealing unit 20 be located at a position at which the sealing portion 20*b* gradually moves away from the to-be-contacted portions 17*b*, 17*c*, and 17*d* around the opening 17*a* (at a position that satisfies the condition: E1<E2).

As described above, the distance between the sealing portion 20*b* that seals the opening 17*a* and each of the to-be-contacted portions 17*b*, 17*c*, and 17*d* located around the opening 17*a* gradually increases as the unsealing operation progresses from the sealing state. As a result, since the friction load imposed on the sealing portion 20*b*, which is an elastic member, is gradually reduced, the unsealing load imposed on the sealing unit 20 can be reduced.

As described above, according to the present disclosure, a sealing member (a sealing portion) which need not be welded around the opening or the like is used, and a member for moving the sealing member is moved during image formation. In this manner, a configuration capable of agitating the toner can be provided.

According to the present disclosure, a developer container unit can be provided that is capable of eliminating the developer shifting to one side of the developer container unit in the direction of the rotational axis of the shaft member with a feeding portion.

According to the present disclosure, in the configuration using a sealing member compressed to seal an opening, the load for moving the sealing member can be reduced.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2018-143288 filed Jul. 31, 2018, No. 2018-143289 filed Jul. 31, 2018, and No. 2018-143290 filed Jul. 31, 2018, which are hereby incorporated by reference herein in their entirety.

What is claimed is:

1. A developer container unit to be mounted in an image forming apparatus that performs an image forming operation on a recording material, comprising:

a frame provided with a developer containing chamber configured to contain developer and an opening for discharging the developer from the developer containing chamber; and a sealing unit configured to seal the opening, the sealing unit including a shaft member rotatable about a rotational axis and a sealing portion attached to the shaft member and compressed by the shaft member and the frame to seal the opening, the sealing unit being rotatable to a close position at which the sealing portion seals the opening, a first open position at which the opening is open, and a second open position at which the opening is open, wherein the sealing unit is configured to agitate the developer by executing a reciprocating motion between the first open position and the second open position during the image forming operation.

2. The developer container unit according to claim 1, wherein an amount of compression by which the sealing portion is compressed during the reciprocating motion is smaller than an amount of compression by which the sealing portion is compressed at the close position.

3. The developer container unit according to claim 2, wherein during the reciprocating motion, the sealing portion is away from the frame.

4. The developer container unit according to claim 1, further comprising:

a regulating portion configured to regulate rotation of the sealing unit by being brought into contact with a regulated portion of the shaft member, wherein when the sealing unit is located at the close position, the regulating portion is in contact with the regulated portion, and wherein during the reciprocating motion, the regulating portion is away from the shaft member.

5. The developer container unit according to claim 4, wherein the regulating portion is a convex portion formed on the frame, and the regulated portion is a concave portion that receives the convex portion.

6. The developer container unit according to claim 1, wherein the sealing unit includes an agitating portion disposed upstream of the sealing portion in an unsealing direction in which the sealing unit moves from the close position to the first open position, and wherein the agitating portion enters the opening during the reciprocating motion.

7. The developer container unit according to claim 6, wherein when the sealing unit is located at the close position, the agitating portion is located upstream of the opening in the unsealing direction.

8. The developer container unit according to claim 6, wherein the agitating portion is integrally formed with the sealing portion.

9. The developer container unit according to claim 1, wherein the shaft member is disposed inside of the developer containing chamber.

10. The developer container unit according to claim 1, further comprising:

a drive transmission portion configured to transmit a driving force received from the image forming apparatus to the sealing unit, wherein the drive transmission portion moves the sealing unit from the close position toward the first open position and moves the sealing unit between the first open position and the second open position.

11. The developer container unit according to claim 10, wherein the drive transmission portion includes a first transmission member connected to the sealing unit, a second transmission member configured to be intermittently brought into contact with the first transmission member and transmit the driving force to the first transmission member, and a biasing member configured to bias the first transmission member, and wherein during a period of time in which the second transmission member is separated from the first transmission member, the biasing member moves the first transmission member in a direction opposite to a direction in which the first transmission member is moved by the second transmission member.

12. The developer container according to claim 1, wherein the sealing unit including a first feeding portion and a second feeding portion that are inclined with respect to the rotational axis, wherein when a direction of the rotational axis is defined as an axial direction, the first feeding portion is disposed between a center portion of the shaft member and one end of the shaft member, and the second feeding portion is disposed between the center portion of the shaft member and the other end of the shaft member, wherein the first feeding portion includes a first inner side surface facing toward the center portion of the shaft member and a first outer side surface facing toward the one end in the axial direction, wherein the second feeding portion includes a second inner side surface facing toward the center portion of the shaft member and a second outer side surface facing toward the other end in the axial direction, wherein when the shaft member rotates in a first direction, the first inner side surface feeds a developer toward the center portion in the axial direction, and the second inner side surface feeds the developer toward the center portion in the axial direction, and wherein when the shaft member rotates in a second direction opposite to the first direction, the first outer side surface feeds the developer toward the one end in the axial direction, and the second outer side surface feeds the developer toward the other end in the axial direction.

13. The developer container unit according to claim 12, wherein during the reciprocating motion, the first feeding portion and the second feeding portion are moved such that portions thereof located above a horizontal plane that passes through the rotational axis is larger than portions thereof located below the horizontal plane.

14. The developer container unit according to claim 12, wherein a maximum value of acceleration of the shaft member when the shaft member rotates in the first direction is larger than a maximum value of the acceleration of the shaft member when the shaft member rotates in the second direction.

15. A developing apparatus comprising:

the developer container unit according to claim 1; and a developer bearing member configured to bear the developer.

16. A process cartridge comprising:

the developer container unit according to claim 1;

a developer bearing member configured to bear the developer; and an image bearing member configured to bear a latent image.

17. A developer container unit comprising:

a frame provided with a developer containing chamber configured to contain developer and an opening for discharging the developer from the developer containing chamber; and a sealing unit configured to seal the opening, the sealing unit including a shaft member rotatable about a rotational axis and a sealing portion attached to the shaft member and compressed by the shaft member and the frame to seal the opening, the sealing unit being rotatable in an unsealing direction from a close position at which the sealing portion seals the opening toward an open position at which the opening is open, wherein the frame includes a contact wall in contact with the sealing portion when the sealing unit moves from the close position to the open position, and wherein the contact wall and the shaft member are disposed such that, when the sealing unit rotates in the unsealing direction, an amount of compression of the sealing portion in an orthogonal direction that is orthogonal to the rotational axis decreases toward a downstream end in the unsealing direction.

18. The developer container unit according to claim 17, wherein as viewed in a direction of the rotational axis, the contact wall includes a circular arc shape, and a position of the center of the circular arc differs from a position of the rotational axis.

19. The developer container unit according to claim 17, wherein when the sealing unit is located at the open position, the sealing portion is away from the frame.

20. The developer container unit according to claim 17, wherein the shaft member is disposed inside of the developer containing chamber.

21. A developing apparatus comprising:

the developer container unit according to claim 17; and a developer bearing member configured to bear the developer.

22. A process cartridge comprising:

the developer container unit according to claim 17;

a developer bearing member configured to bear the developer; and an image bearing member configured to bear a latent image.

* * * * *